US007771248B2

(12) United States Patent
Vianello et al.

(10) Patent No.: US 7,771,248 B2
(45) Date of Patent: Aug. 10, 2010

(54) AUTOMATIC MACHINE FOR ARRISSING AND GRINDING THE EDGES OF GLASS SHEETS

(75) Inventors: Fortunato Vianello, Vallio di Roncade (IT); Dino Moschini, Roncade (IT)

(73) Assignee: For.El. Base di Vianello Fortunato & C. SNC, Vallio di Roncade (IT)

( * ) Notice: Subject to any disclaimer, the term of this patent is extended or adjusted under 35 U.S.C. 154(b) by 735 days.

(21) Appl. No.: 11/528,608

(22) Filed: Sep. 28, 2006

(65) Prior Publication Data

US 2007/0075474 A1 Apr. 5, 2007

(30) Foreign Application Priority Data

Oct. 3, 2005 (IT) ..... TV2005A0145

(51) Int. Cl.
*B24B 1/00* (2006.01)
*B24B 51/00* (2006.01)

(52) U.S. Cl. ..... 451/5; 451/8; 451/41; 269/55

(58) Field of Classification Search ..... 451/5–10, 451/41, 42, 44; 269/55
See application file for complete search history.

(56) References Cited

U.S. PATENT DOCUMENTS

| | | | | |
|---|---|---|---|---|
| 3,943,667 | A * | 3/1976 | Hoenigmann | 451/261 |
| 7,094,128 | B2 * | 8/2006 | Vianello et al. | 451/5 |
| 2004/0259475 | A1 * | 12/2004 | Vianello et al. | 451/5 |
| 2005/0233472 | A1 * | 10/2005 | Kao et al. | 436/180 |
| 2007/0075474 | A1 * | 4/2007 | Vianello et al. | 269/55 |

FOREIGN PATENT DOCUMENTS

| | | | |
|---|---|---|---|
| DE | 102 55 171 | A1 | 6/2004 |
| EP | 1 063 053 | A2 | 12/2000 |
| EP | 1 314 513 | A2 | 5/2003 |
| EP | 1 488 886 | A | 12/2004 |

* cited by examiner

*Primary Examiner*—Lee D Wilson
(74) *Attorney, Agent, or Firm*—Modiano & Associati; Albert Josif; Daniel J. O'Bryne

(57) ABSTRACT

An automatic machine for arrissing the edges of glass sheets, comprising devices that allow to work glass sheets by way of rigid tools, such as diamond grinding wheels, by acting simultaneously on the two face edges along the perimeter of the sheet. The machine comprises at least one working head, provided with a tool with a probe and feedback circuits for grinding symmetrically the glass sheet and following the perimetric profile of the sheet by a combined action of moving the glass sheet and at least one working head.

15 Claims, 24 Drawing Sheets

AUTOMATIC MACHINE FOR ARRISSING AND GRINDING THE EDGES OF GLASS SHEETS

The present invention relates to an automatic machine for arrissing and grinding the edges of glass sheets.

BACKGROUND OF THE INVENTION

Methods for grinding (or, in the jargon, arrissing) the edges of glass sheets in the condition in which they are after cutting into the final formats for use are currently known. In principle, arrissing can be applied to any step of the working of the glass sheets, for example before tempering.

Arrissing is performed for two reasons: the first relates to safety in handling the sheets, in which the edges would be dangerously sharp if they were not arrissed. The second reason relates to eliminating the edge defects of the sheets, typically so-called microcracks, which might trigger breakages of the sheet in the subsequent working steps (particularly during tempering) and also during subsequent use.

In order to better understand the configuration of the glass sheet, not so much in its possible isolated use but most of all in its use in combination with other components to constitute the so-called double glazing unit, some concepts related to the intermediate component, i.e., the glass sheet, and the final product, i.e., the double glazing unit, are summarized hereafter. The subsequent use of the double glazing unit, i.e., as a component of doors and windows, is known to the person skilled in the art and is not discussed here in detail.

With reference to FIG. 1, the double glazing unit is constituted typically by two or more glass sheets 1001, 1002, which are mutually separated by one or more spacer frames 1003, which are internally hollow and are provided with fine perforations on the face directed toward the inside of the chamber.

The spacer frames 1003 usually contain, in their hollow part, hygroscopic material, which is not shown in the figure. A chamber (or chambers) 1006 delimited by the sheets 1001 and 1002 and by the frame 1003 can contain air or gas or mixtures of gas injected therein, which give the double glazing unit particular properties, for example thermal insulation and/or soundproofing properties. Coupling between the glass sheets and the frame is achieved by means of two levels of sealing: a first seal 1004 is intended to provide a hermetic closure and affects the lateral surfaces of the frame 1003 and the portion that is adjacent thereto of the glass sheets 1001, 1002; a second seal 1005 affects the compartment constituted by the outer surface of the frame and by the faces of the glass sheets up to their edge and is intended to produce cohesion among the components and maintain the mechanical strength of their mutual coupling.

FIG. 1 shows five possible sectional views of configurations of double glazing units 1A, 1B, 1C, 1D, 1E, only the first of which has been commented. However, it is straightforward to extend the above description to configurations 1B-1E, in which there are several frames or several glass sheets, the latter being optionally laminated. In the figure, the sun represents schematically the outside environment of a building in which the double glazing units are installed, while the inside of the building is represented schematically by a radiator.

The glass sheets used in the composition of the double glazing unit can have different shapes depending on use: for example, the outer glass sheet 1001 (with respect to the building) can be normal or reflective (in order to limit heat input during summer months) or it can be laminated/armored (for intrusion prevention/vandalism prevention functions) or can be laminated/tempered (for safety functions) or combined, for example reflective and laminated.

The internal sheet 1002 (with respect to the building) can be normal or of the low-emissivity type (in order to limit the dispersion of heat during winter months) or can be laminated/tempered (for safety functions) or can be combined, for example low-emissivity and laminated.

The simple summary given above already clearly shows that a production line for obtaining a double glazing unit requires many processes in sequence and that in both the intermediate components (i.e., the glass sheets) and the end product (i.e., the double glazing unit), the edges of the glass sheets can be accessed for contact with the hands of operators and users. It is therefore important to increase safety by beveling the peripheral edges of the glass sheets. If the finished product, which has a considerable added value with respect to the individual sheet, had sheet edges that could cut or sheets with non-rounded edges, it would be degraded in terms of quality and commercial value.

The processes for producing the double glazing unit typically are numerous, and each one requires a corresponding and particular machine to be arranged in series with respect to the other complementary ones. By way of non-limiting example, some processes or operations, not all of which are necessary, are the following:

EDGING on the peripheral face of the glass sheet to remove any coatings, in order to allow and maintain over time the adhesion of the sealants;

WASHING of the individual sheets, alternating an internal sheet with an external sheet (the orientation being the one defined above);

APPLICATION OF THE SPACER FRAME: the frame, manufactured beforehand, filled with hygroscopic material and coated on its lateral faces with an adhesive sealant having sealing functions, is applied to one of the sheets that constitute the double glazing unit in a suitable station of the double glazing unit production line;

MATING AND PRESSING of the assembly constituted by the sheets and the frame (or frames);

FILLING WITH GAS of the chamber (or chambers) thus obtained;

SECOND SEALING.

The processes described above can be performed by the respective machine automatically or semiautomatically, but in any case they entail the contact of the intermediate components and of the finished products with the operator, for example in the steps for loading and unloading the line and in the subsequent steps for storage, transport, assembly and installation of the double glazing units.

As regards arrissing, which is not included in the list of processes described above, in the known manual method glass sheets, rested on supporting surfaces are placed in contact with belt arrissers, which are arranged sequentially and are angularly offset so as to bevel both edges of the side of the sheet (methods of this type are described for example in DE-A 44 19 963). EPA 0 920 954 describes an apparatus for beveling, by means of an automatic method, sheets of cut glass which uses a pair of abrasive belts.

The main drawbacks that arise from the known methods described above relate to the considerable bulk and cost of the machines, to the complex operations for process maintenance (such as the replacement of the abrasive belts), to the less than optimum quality of the arrissing operation, to the abnormal behavior of the belt in interaction with the glass when its width does not mate fully with the sheet (i.e., at the end of the side of the sheet), and finally the excessively long production times.

The Applicant of the present invention is also applicant of EPA 1 488 886, the invention device of which, designated as "machine for glass pane border grinding", will be used, in one possible configuration, in combination with the subject of the present invention.

SUMMARY OF THE INVENTION

The aim of the present invention is to solve the above-mentioned technical problems, eliminating all the drawbacks of the cited background art, by providing a machine that allows to arriss the edges of glass sheets safely and cheaply, achieving a superior qualitative result with respect to the background art.

Within this aim, an object of the present invention is to automate the arrissing operation, minimizing interventions on the part of operators.

Another object is to avoid altering the structure of the production line, benefiting from the modularity that typically characterizes it.

Another object is to ensure symmetrical beveling of the edges, independently of the surface irregularity of the edge of the glass sheet or of the laminated glass sheets.

Another object is to perform arrissing substantially independently of the perimetric profile of the glass sheet.

A further object is to eliminate the surface irregularities that typically characterize the lateral surface of glass sheets;

A still further object is to increase productivity by reducing the processing time.

This aim and these and other objects, which will become better apparent hereinafter, are achieved by an automatic machine for arrissing the edges of substantially flat glass sheets; characterized in that it comprises a machine body and at least two working heads, which are adapted to make contact with the edges of the sheet, each being movable independently along a vertical axis, each of said working heads comprising a tool body which can move substantially transversely to the plane of the sheet, the tool body further comprising an abrasive tool for arrissing and at least one probe, which is arranged upstream of the work area of the abrasive tool with respect to the direction of relative advancement of the tool with respect to the sheet, so as to make contact with the edge being worked of the sheet before the abrasive tool, each tool body comprising sensors adapted to detect a relative movement between the probe and the abrasive tool caused by local misalignment between the edge of the sheet being worked and the abrasive tool.

Advantageously, the at least two working heads can move vertically along guides arranged on the opposite faces of a beam, which is also arranged vertically in the machine body.

Advantageously, the glass sheet is arranged vertically, rests on a sliding surface and can move horizontally on a conveyor.

The arrangement defined as vertical is actually slightly tilted with respect to the vertical plane (generally by 6°) in order to give static stability to the glass sheet, i.e., prevent its tipping.

BRIEF DESCRIPTION OF THE DRAWINGS

Further characteristics and advantages of the invention will become better apparent from the following detailed description of particular embodiments of the invention, illustrated by way of non limiting example in the accompanying drawings, wherein.

DESCRIPTION OF THE PREFERRED EMBODIMENTS

As described earlier, FIG. 1 illustrates schematically the peripheral portion of the double glazing unit according to an exemplifying series of possible combinations: normal configuration (1A), triple glazing (1B), offset sheets (1C), laminated outer sheet and low-emissivity inner sheet (1D), tempered reflective outer sheet and laminated low-emissivity inner sheet (1E). The two types of sealant used are indicated: the butyl sealant 1004, which has a sealing, function (first seal) and is applied between the lateral surfaces of the frame and the glass sheets, and the polysulfide or polyurethane or silicone sealant 1005, which is intended to provide mechanical strength (second seal) and is applied between the outer surface of the frame and the inner faces of the glass sheets up to their edges.

Figure 1:
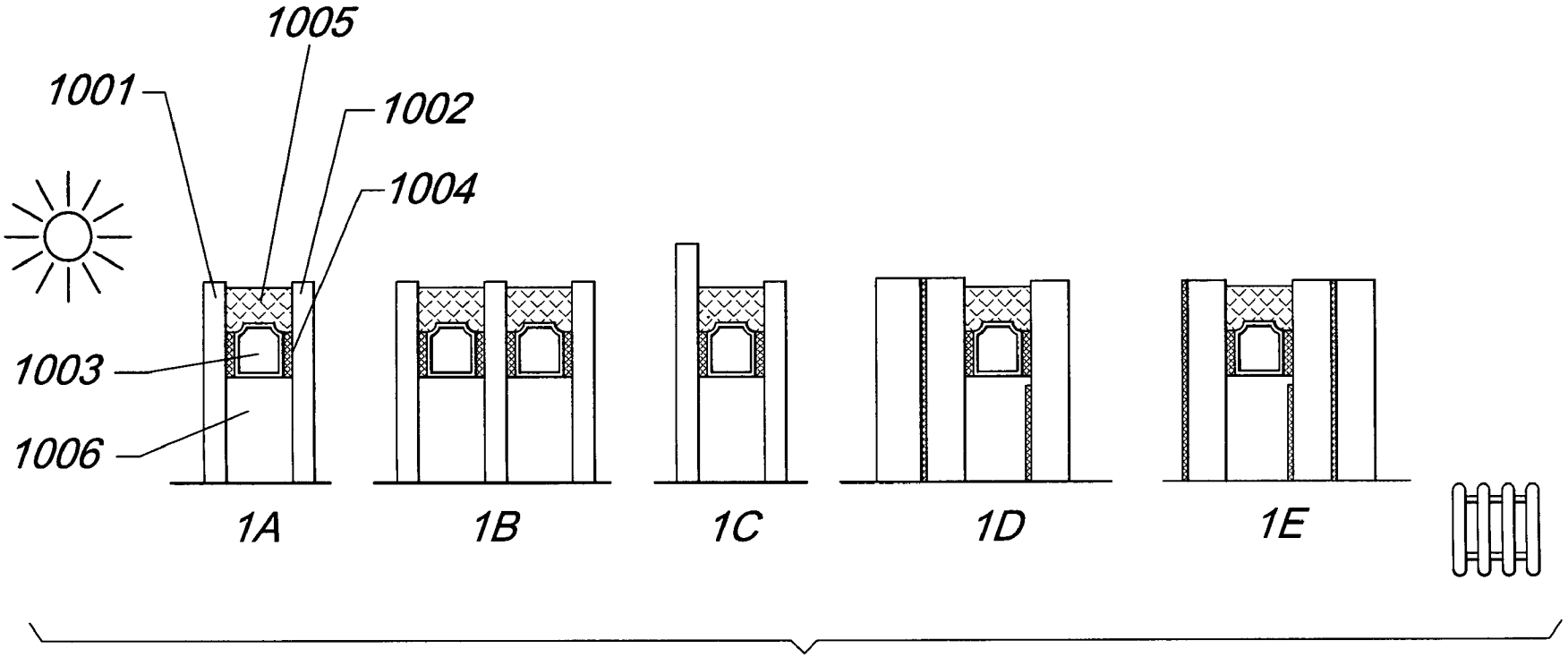
FIG. 1 is a partial sectional view of a series of typical double glazing unit configurations.

FIG. 1 shows that even after the second seal the double glazing unit has two particularly dangerous outer perimeters due to the sharpness of the edges of the glass sheets. It is in fact known that the rim of glass sheets obtained by mechanical cutting (scoring with a diamond tool and subsequent breaking by localized flexing) has edges which are as sharp as a sharpened blade. It is also known that the rim of cut glass sheets is never perfectly perpendicular to the plane of the sheets but is typically inclined, as shown by way of example in FIGS. 14*a*, 14*b*, 15*a* and 15*b*.

With reference to the figures, single-digit numerals designate the main assemblies of the machine so as to have an overview thereof, whereas the details and constructive mechanisms are designated by three-digit numerals, the first digit of which is the digit of the main assembly to which it belongs; four-digit numerals designate the components of the double glazing unit.

The reference numeral 1 designates an individual glass sheet, the sides of which are designated respectively as follows: the front side 1*a*, the longitudinal sides 1*b* and 1*c* (which are worked simultaneously along certain portions), and the rear side 1*d*. The adjectives "front" and "rear" refer to the direction of movement of the glass sheet within the machine. These conventions and numberings are given in FIG. 23.

Figure 2:
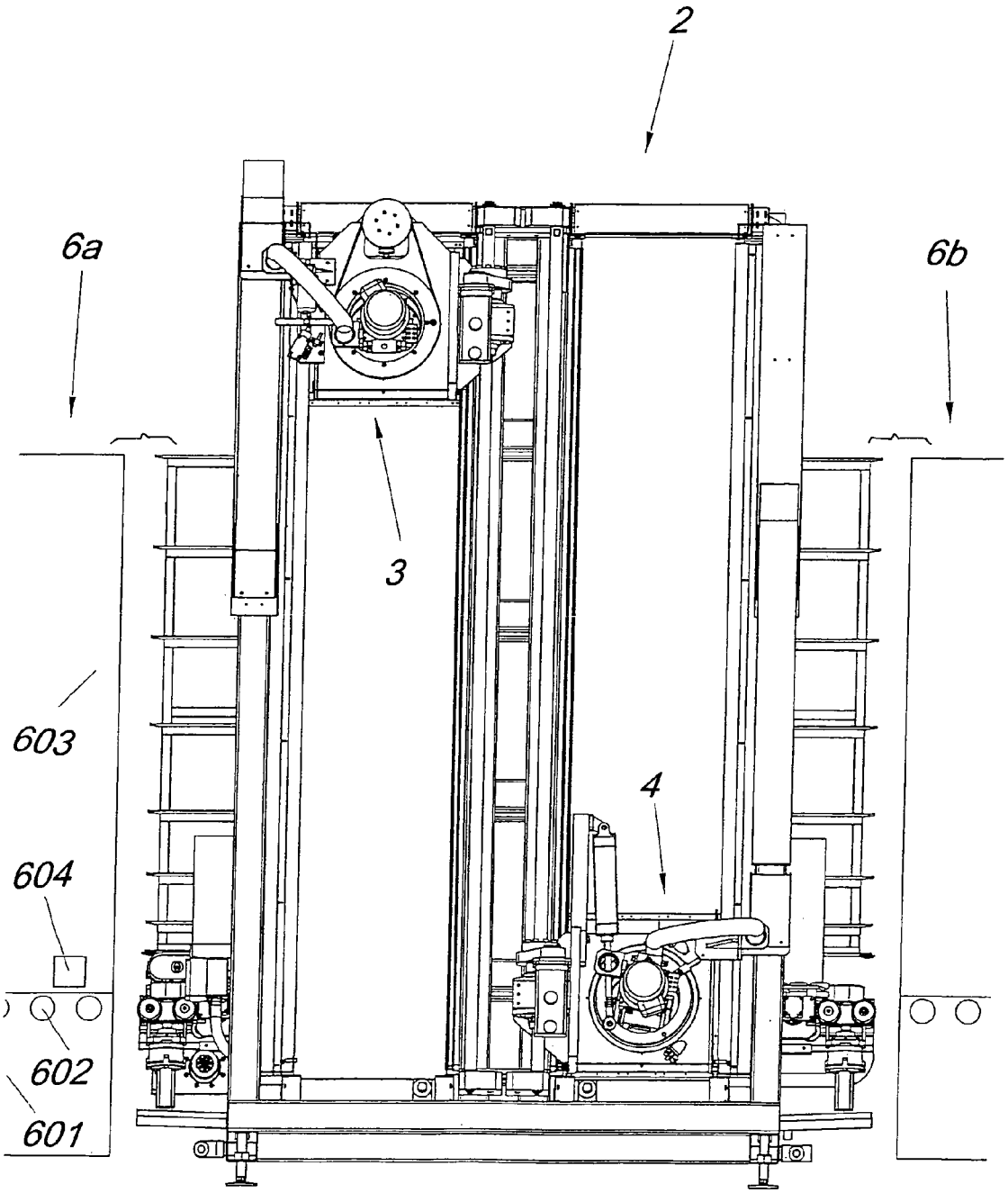
FIG. 2 is a general front view of the machine that incorporates the invention.

With reference to FIG. 2, the machine according to the preferred embodiment comprises a main body 2, which is sequentially connected between two conveyors 6*a* and 6*b*, which are arranged respectively upstream and downstream of the machine body 2. The machine body 2 comprises a first arrissing or beveling section 3 and a second arrissing or beveling section 4.

Figure 4:
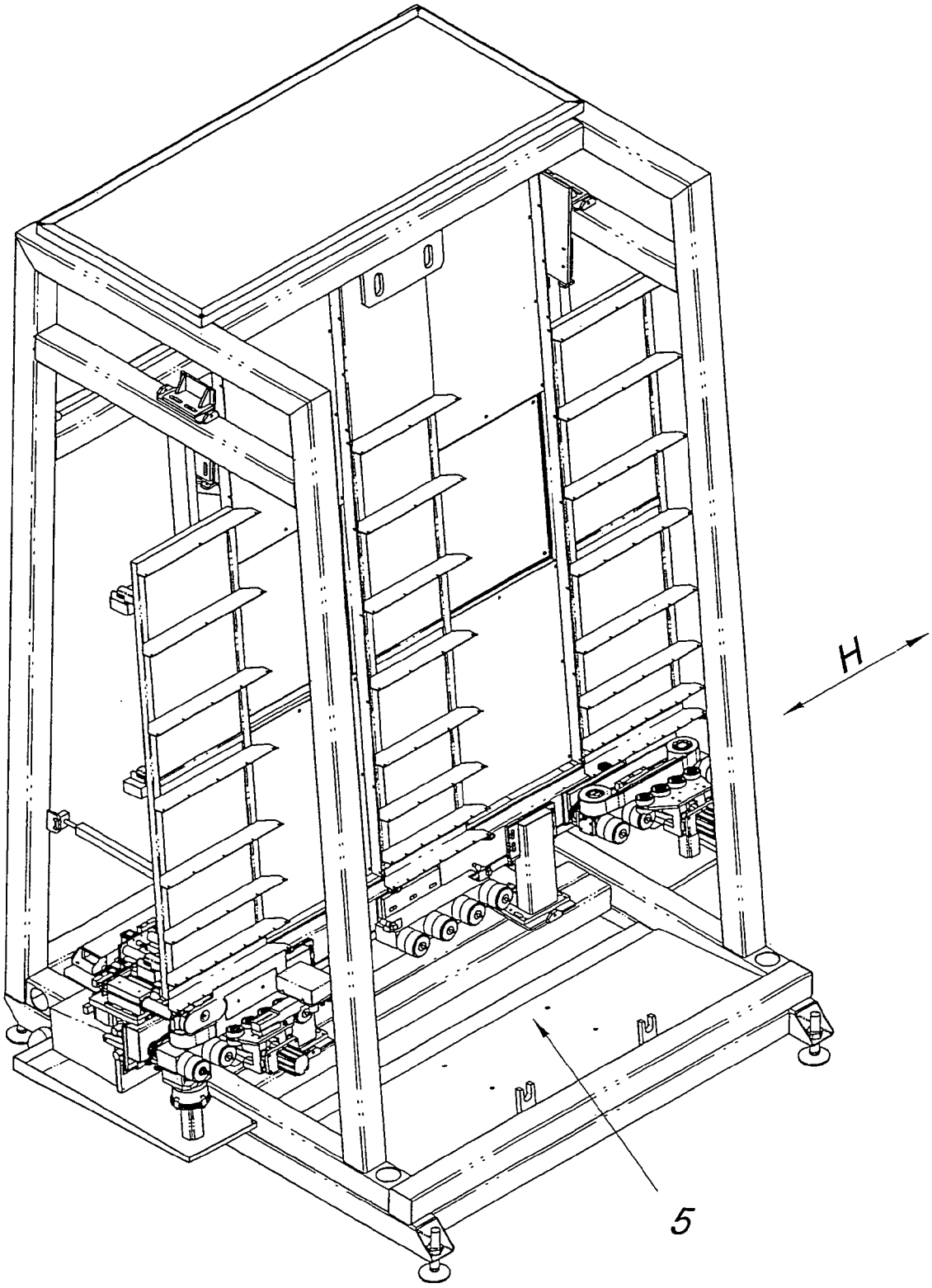
FIG. 4 is a perspective view of the part of the machine that produces the movement of the glass sheet along the horizontal axis H.
Figure 5:
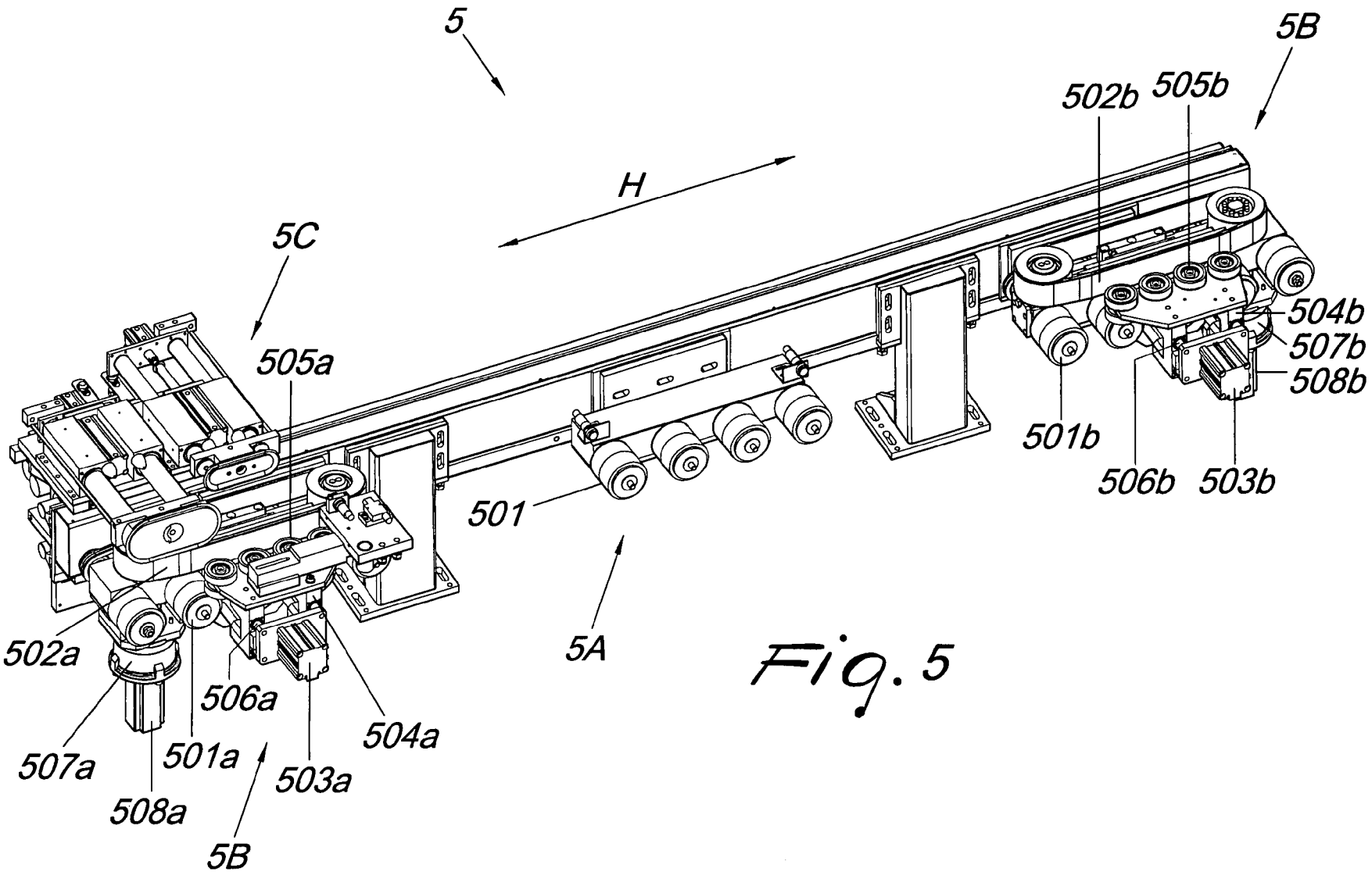
FIG. 5 is a detail perspective view of the internal components of the machine that produce the movement of the glass sheet along the horizontal axis H.
Figure 6:
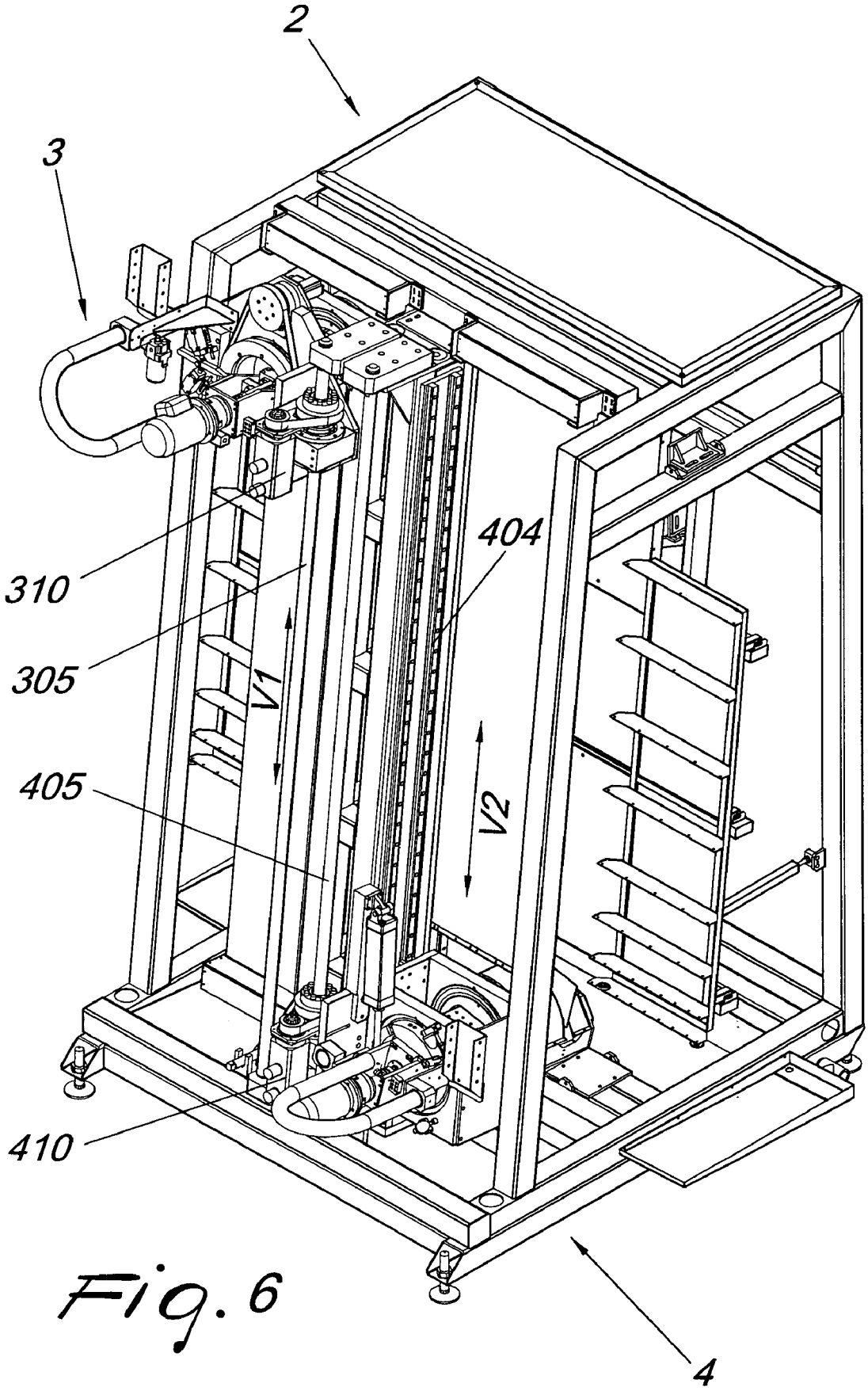
FIG. 6 is a perspective view of the part of the machine that produces the vertical movements of the working heads along the vertical axes V1 and V2.

With reference to FIGS. 4 and 5, the reference numeral 5 designates a longitudinal conveyor of the glass sheet, which can be divided into parts 5A, related to the supporting means (typically motorized and free rollers) and 5B related to conveyance means of the belt type and 5C related to conveyance means of the type of a carriage provided with suckers.

A section 7, which is not shown as it is known, comprises a hydraulic pump, which draws water from a recirculation tank in order to direct a stream of water toward any pre-washing nozzles, toward the glass sheet centering mechanisms and towards the arrissing tools of sections 3 and 4, so as to clean the glass sheet, lubricate the interface between the glass sheet and the centering supports, and cool the working area of the tools.

With reference to FIGS. 2 to 13, the arrissing sections 3 and 4 each comprise a working head 300, 400, a set of sliding blocks with balls for coupling the glass sheets, said assembly comprising at the front and at the rear at least one main ball which is free to move on a cradle of secondary balls.

Again with reference to FIG. 2, the machine according to one embodiment of the invention comprises an input conveyor 6*a* (shown only schematically, since it is known), the arrissing sections 3 and 4, and an output conveyor 6*b* (shown only schematically, since it is known), which are arranged in a sequential configuration. The input conveyor 6*a* can be connected to an upstream working section, for example the section for cutting the glass into sheets or the edging machine, or as an alternative the glass sheet to be ground can also be loaded manually onto the input conveyor 603, independently of the production line.

Figure 3:
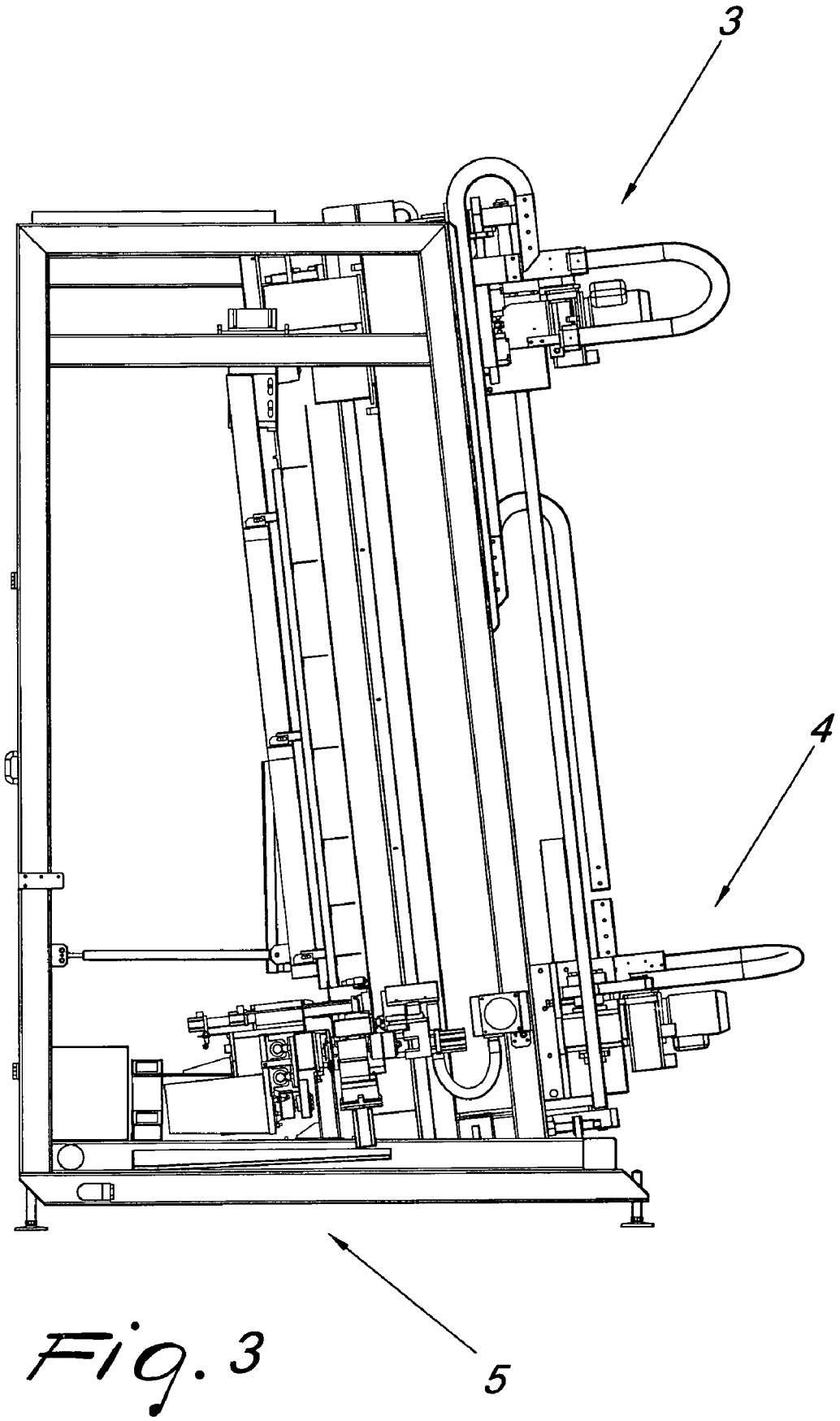
FIG. 3 is a general side view of the machine that incorporates the invention.

The output conveyor 6*b* can instead be connected to a downstream working section, for example the section where the manufacture of the double glazing units begins, in particular the washing unit. Both conveyors, as well as the central machine body, keep the sheet at an inclination of approximately 6° with respect to the vertical, as shown in FIG. 3.

The input conveyor 6*a* comprises a base 601 for supporting the lower edge of the glass sheet, on which there is a series of motorized support and conveyance rollers 602. The conveyor further comprises a supporting surface 603, on which the glass sheet is rested substantially vertically in the direction shown above.

The conveyors are well-known and therefore are not discussed here in detail. It is therefore straightforward to understand that the output conveyor 6*b* is substantially similar to the input conveyor.

The input conveyor preferably comprises a known type of thickness detector 604 for measuring the thickness of the glass sheet to be worked before it enters the arrissing sections 3 and 4, in order to provide a signal for the initial centering of the abrasive tool of the first arrissing section 3 with respect to the edge of the glass sheet.

The arrissing sections 3 and 4 comprise, in their interspace, a series of free rollers 501, which belong to the assembly 5A, for supporting the base of the glass sheets being worked.

The glass sheet 1 that arrives from the preceding working machine (or that is loaded manually or by means of a loading unit onto the input conveyor 6*a* of the machine) is made to advance by being conveyed by support and conveyance rollers 602 of the conveyor 6*a* and by motorized support and conveyance rollers 501*a* of the section 5A of the arrissing station 3 and by a synchronous belt drive 502*a* until it reaches the zero position with respect to the abrasive tool 301 of the arrissing station 3.

Figure 17:
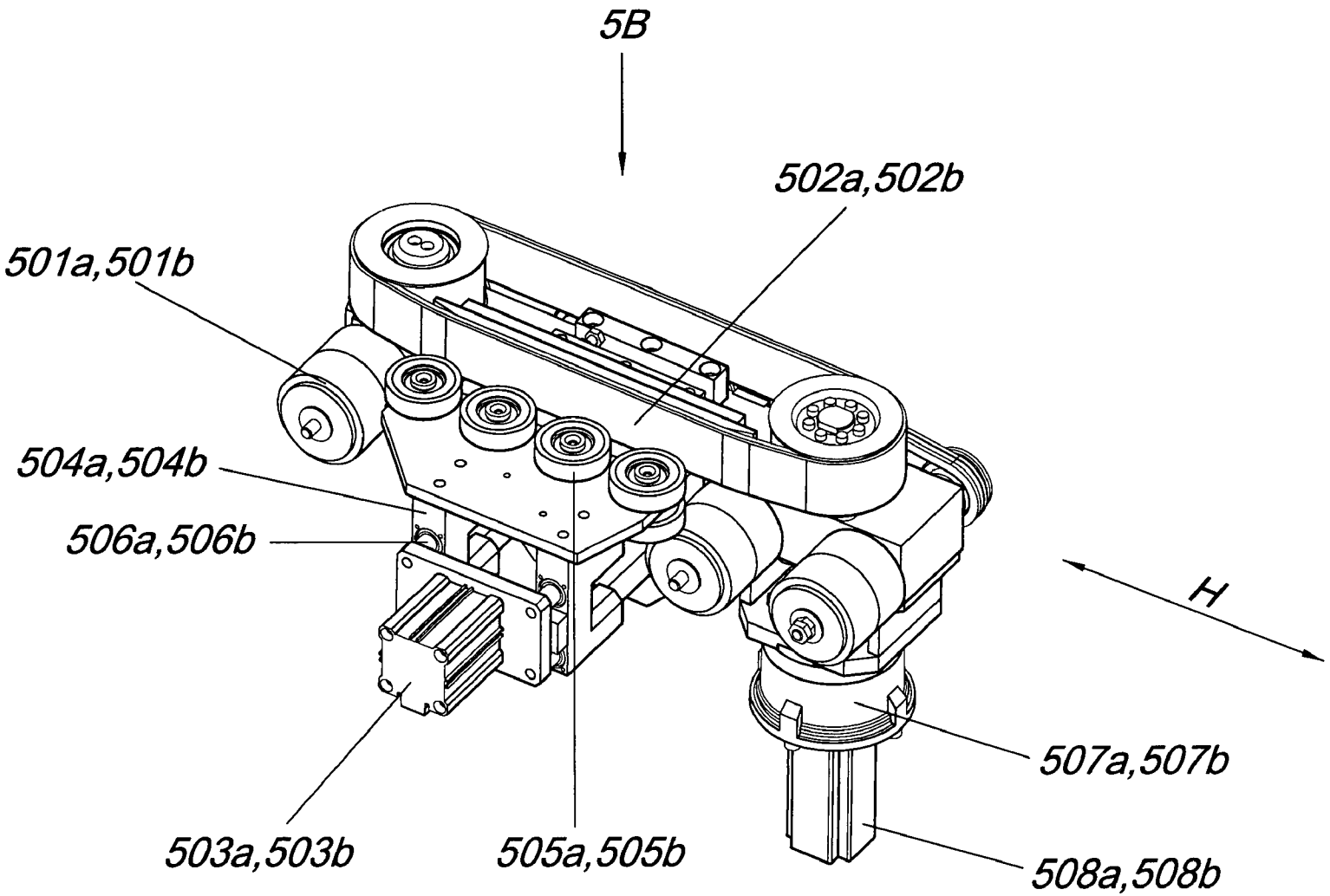
FIG. 17 is a detail, perspective view of the mechanisms of the belt-drive type that move the glass sheet along the horizontal axis H.

The opposite forces for restraining the glass sheet 1 and allowing effective driving thereof by the belt 502*a* are obtained by way of the action of a cylinder 503*a*, which pushes a carriage 504*a*, which is provided with a set of wheels 505*a* and can move on guides 506*a* against the belt 502*a* actuated in its motion for conveying the sheet 1 synchronously by means of a reduction unit 507*a* by a synchronous motor 508*a* (see FIGS. 5 and 17).

On the basis of the mechanism described above, the glass sheet 1 is thus conveyed to the section where the working head 3, described in detail hereafter, operates.

This control of the position of the glass sheet 1 is important for the correct operation of the process performed by the working head 300, as will become apparent from the continuation of the description, and if the glass sheets to be worked are not rectangular, it is also important for the coordination of the horizontal movement H of the glass sheet and the vertical movement V1 of the working head 300, which is required to ensure that the arrissing tool is always mated with the perimeter of the non-rectangular glass sheet 1.

Figure 18:
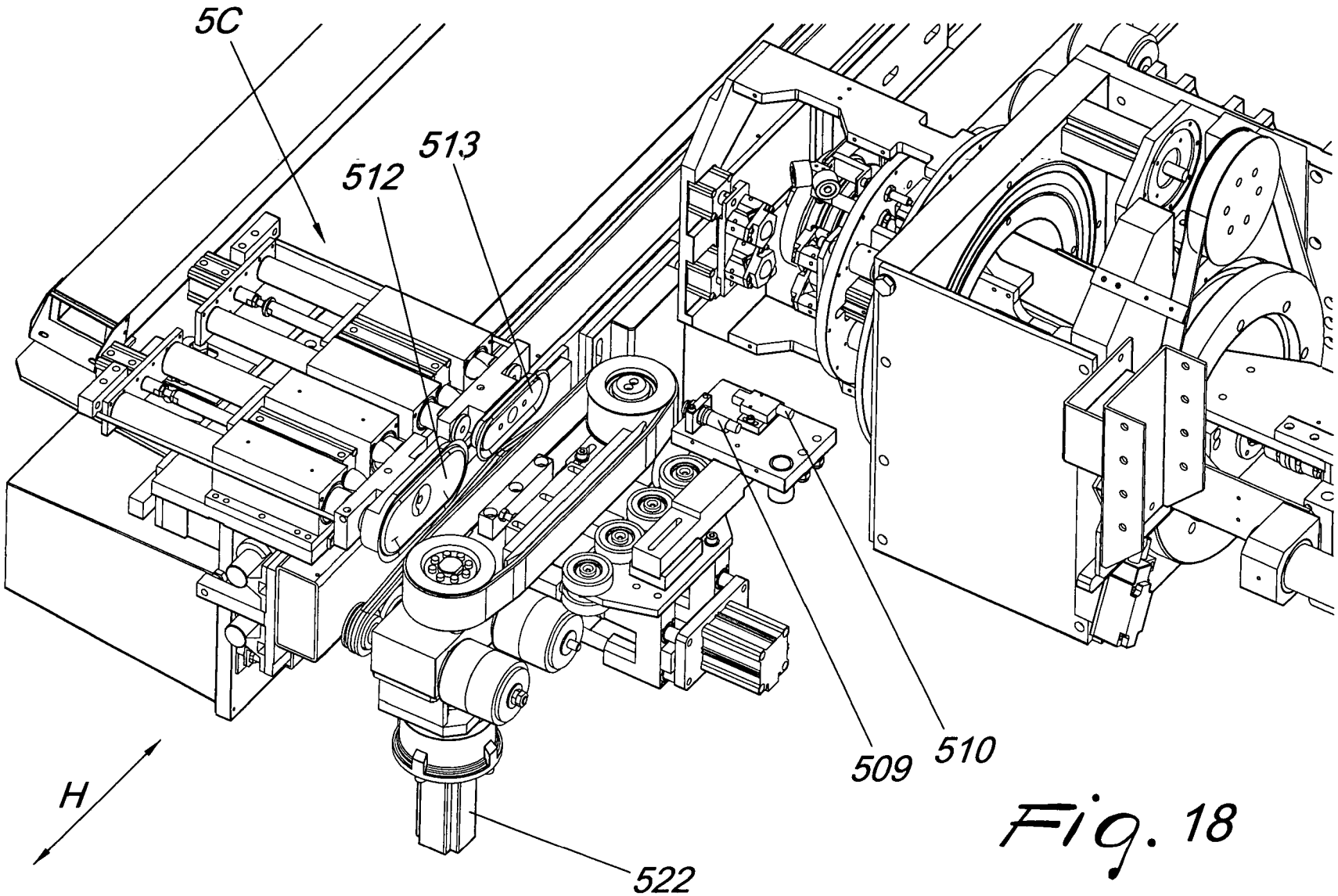
FIGS. 18 and 19 are perspective views of a detail of the mechanisms of the sucker carriage type which move the glass sheet along the horizontal axis H.
Figure 19:
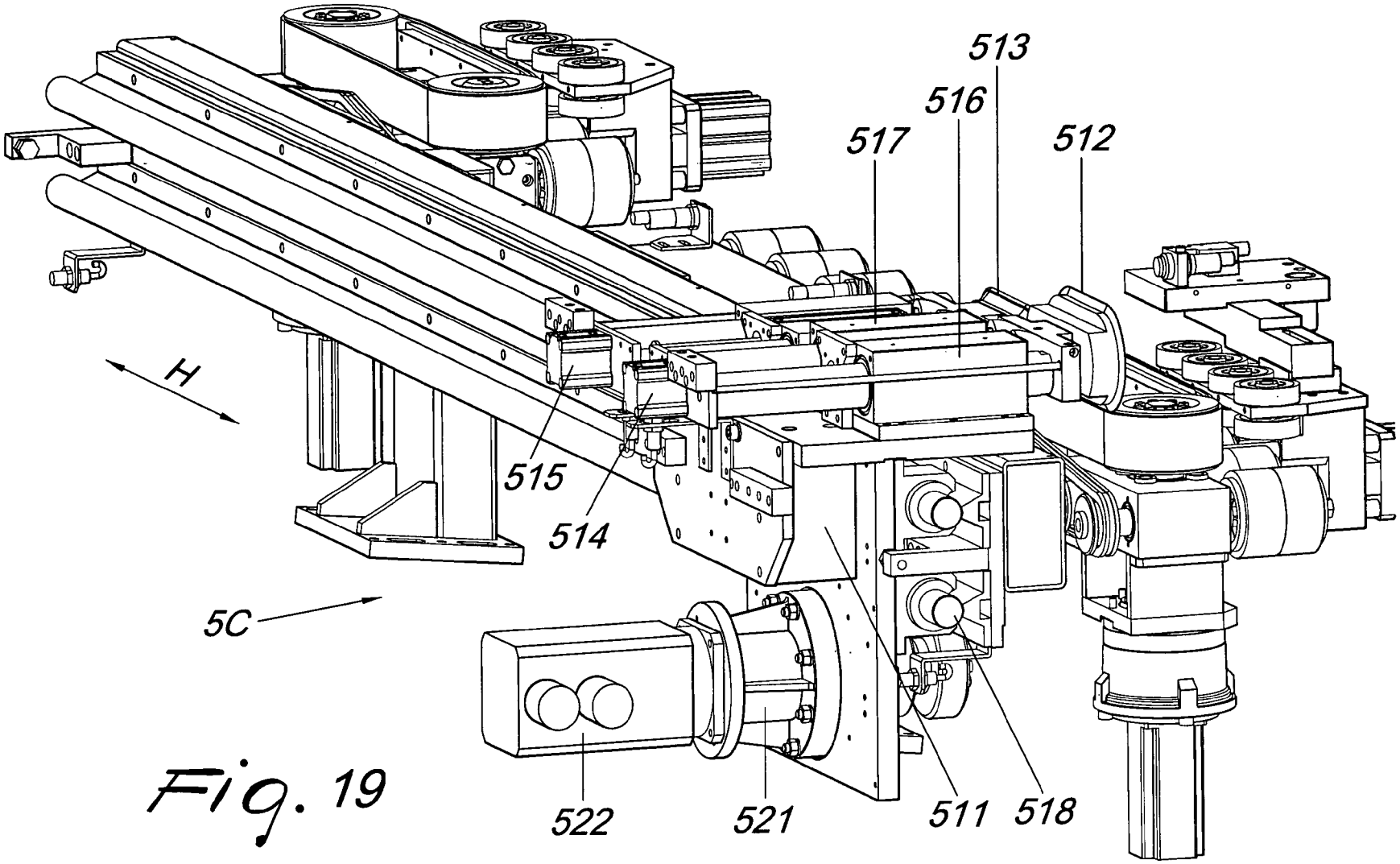

Advantageously, and necessarily for non rectangular glass sheets (for example, with reference to FIG. 23, the sheet 1' having a contour formed entirely by straight portions, the sheet 1" having a contour in which some portions are curved, and the sheet 1'" having a contour in which all the portions are curved), in addition to conveyance by means of belts such as the assemblies 5B, the conveyance of the assembly 5C is used (see FIGS. 18 and 19) by means of a carriage 511 provided with one sucker 512 or more suckers 512, 513, controlled by pneumatic actuators 514 and 515 via linear guides 516 and 517. Said carriage can move on linear guides 518 by way of the actuation of a gear 519 (which is not shown but is known) meshed with a rack 520 (which is not shown but is known), said rack being rigidly coupled to the machine body 2, the actuation elements being in reverse a reduction unit 521 and a synchronous motor 522.

All of said means produce the transfer of the glass sheet 1 along the horizontal axis H, in a manner which is certainly synchronous on the part of the sucker-fitted carriage assembly 5C, and therefore this device is used conveniently for contoured glass sheets, since it is necessary to concatenate the horizontal axis H for the translational motion of the glass sheet and the vertical axis V1 (described hereinafter) for the translational motion of the tool in a sufficiently synchronous manner on the part of the tracked conveyance assemblies 5B, so that said devices are used conveniently for large rectangular glass sheets 1, the range of motion of which exceeds the range allowed by the sucker-fitted carriage of the assembly 5C. Said assembly is used necessarily to work small glass sheets 1 for which support and conveyance would not be provided at the arrissing stations 3, 4, the heads of which occupy a considerable amount of space.

Once the vertical edge 1*a* of the glass sheet 1, synchronized by way of the actuation systems described above, arrives at a slowing sensor 509, the motion of the sheet is slowed until it stops completely once said vertical edge is arranged at a stop sensor 510.

With reference to FIGS. 7 to 13, before describing the operating conditions of the arrissing process, hereinafter the characteristics of the arrissing station 3 are described completely and the characteristics of the arrissing station 4 are described complementarily, since most of the latter is identical to the description of the station 3.

The reference numerals 3 and 4 respectively designate the arrissing stations on the input side and respectively on the output side of the machine 2, which refers to a path for working the glass sheet 1 which goes from the left to the right (a mirror-symmetrical description is obvious for the case in which the path of the glass sheet 1 is from right to left).

The arrissing station 3, provided with the tool 301, can move along the following interlocked axes: V1, ø1, Z1.

In particular, in the interlocking with H, V1 and ø1 are active for working contoured glass sheets such as 1', 1" and 1'"; in the cooperation with H, V1 is active for working rectangular glass sheets 1; while the axis Z1 is always active in cooperation with the probe, described hereinafter, for centering against the rims of the glass sheet.

The arrissing station 4, provided with the tool 401, can move along the following interlocked axes: V2, ø2, Z2. In particular, in the cooperation with H, V2 and ø2 are active for working rectangular glass sheets 1, while the axis Z2 is always active in cooperation with the probe, described hereinafter, for centering against the rims of the glass sheet.

Figure 7:
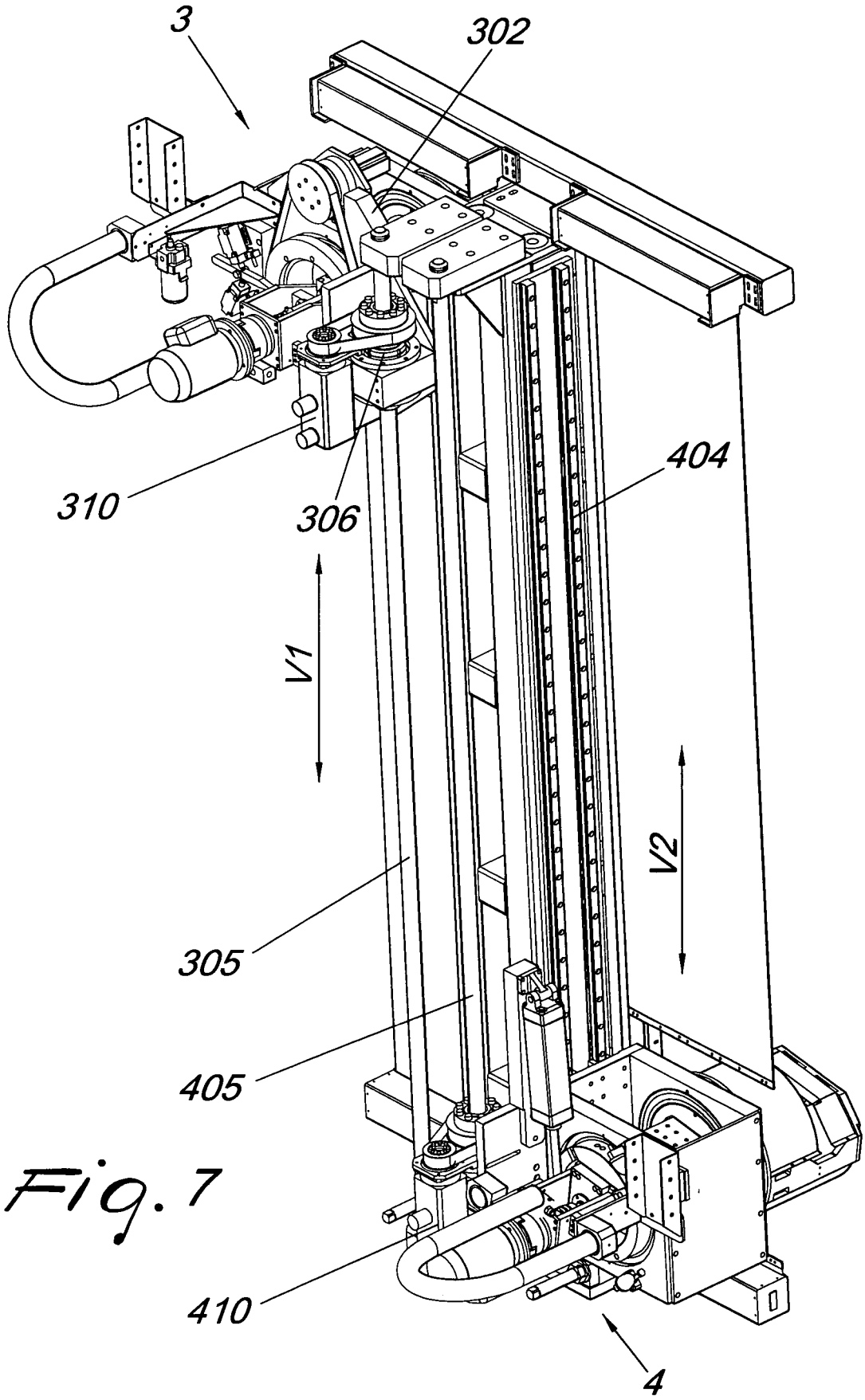
FIG. 7 is a detail perspective view of the internal components of the machine that produce the vertical movements of the working heads along the vertical axes V1 and V2.
Figure 8:
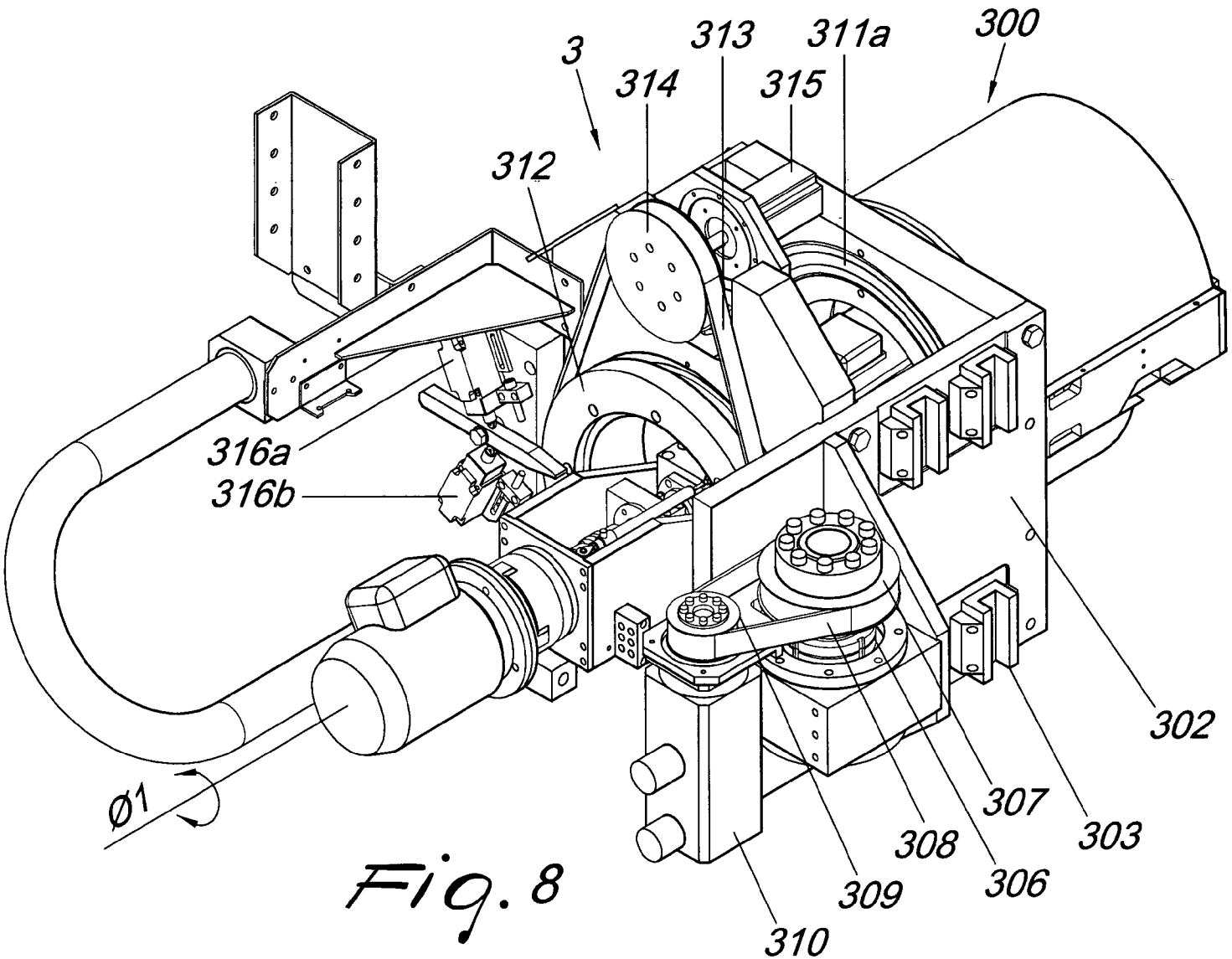
FIG. 8 is a perspective view of the head 300, which is shown without the vertical guides and contains the mechanisms that produce its continuous rotation about the axis ø1.
Figure 9:
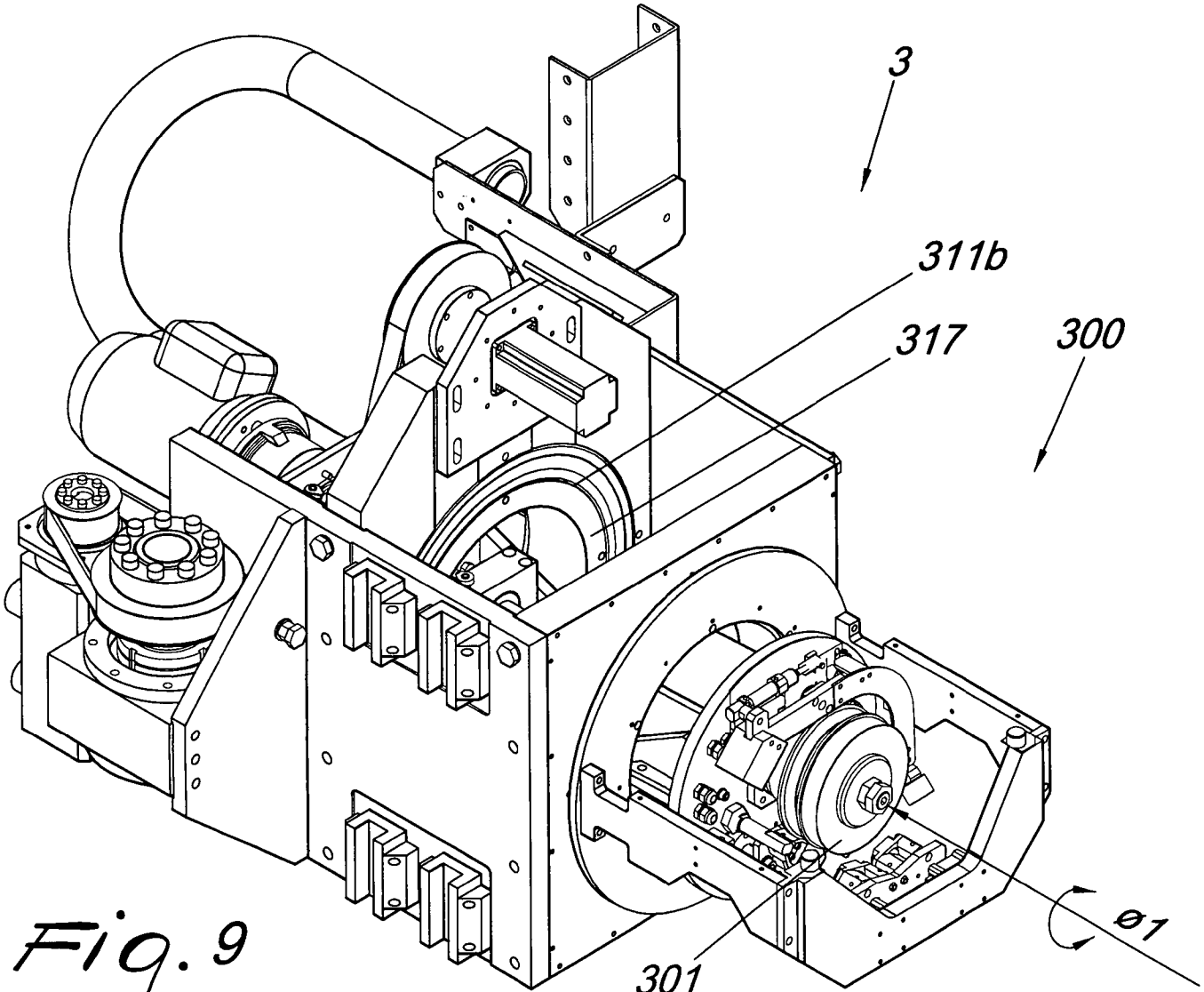
FIG. 9 is a view of the head 300 taken from the opposite side with respect to the controls, i.e., from the working side for arrissing the glass sheet.
Figure 10:
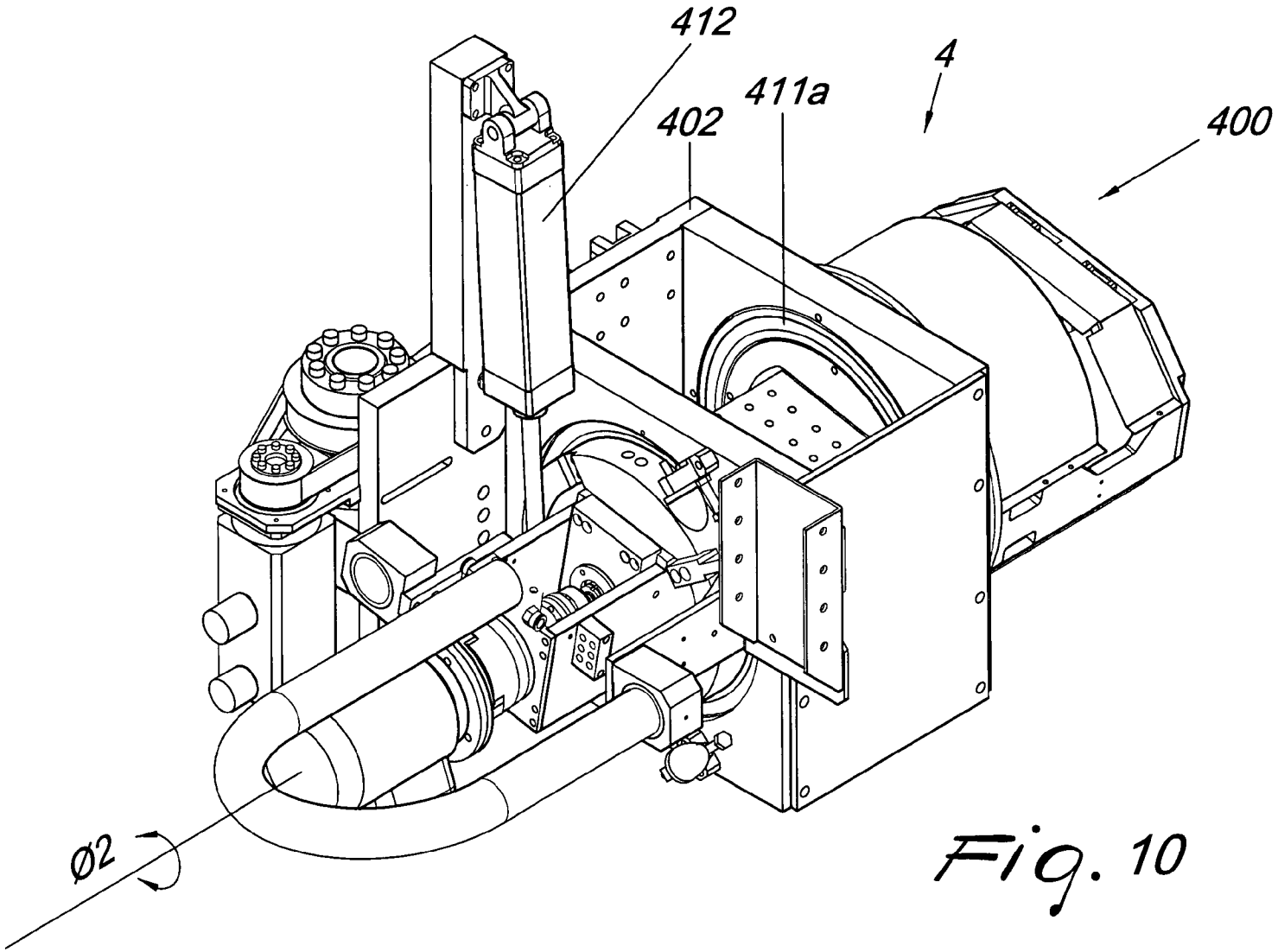
FIG. 10 is a perspective view of the head 400, shown without the vertical guides and containing the mechanisms that produce its continuous rotation about the axis ø2.
Figure 11:
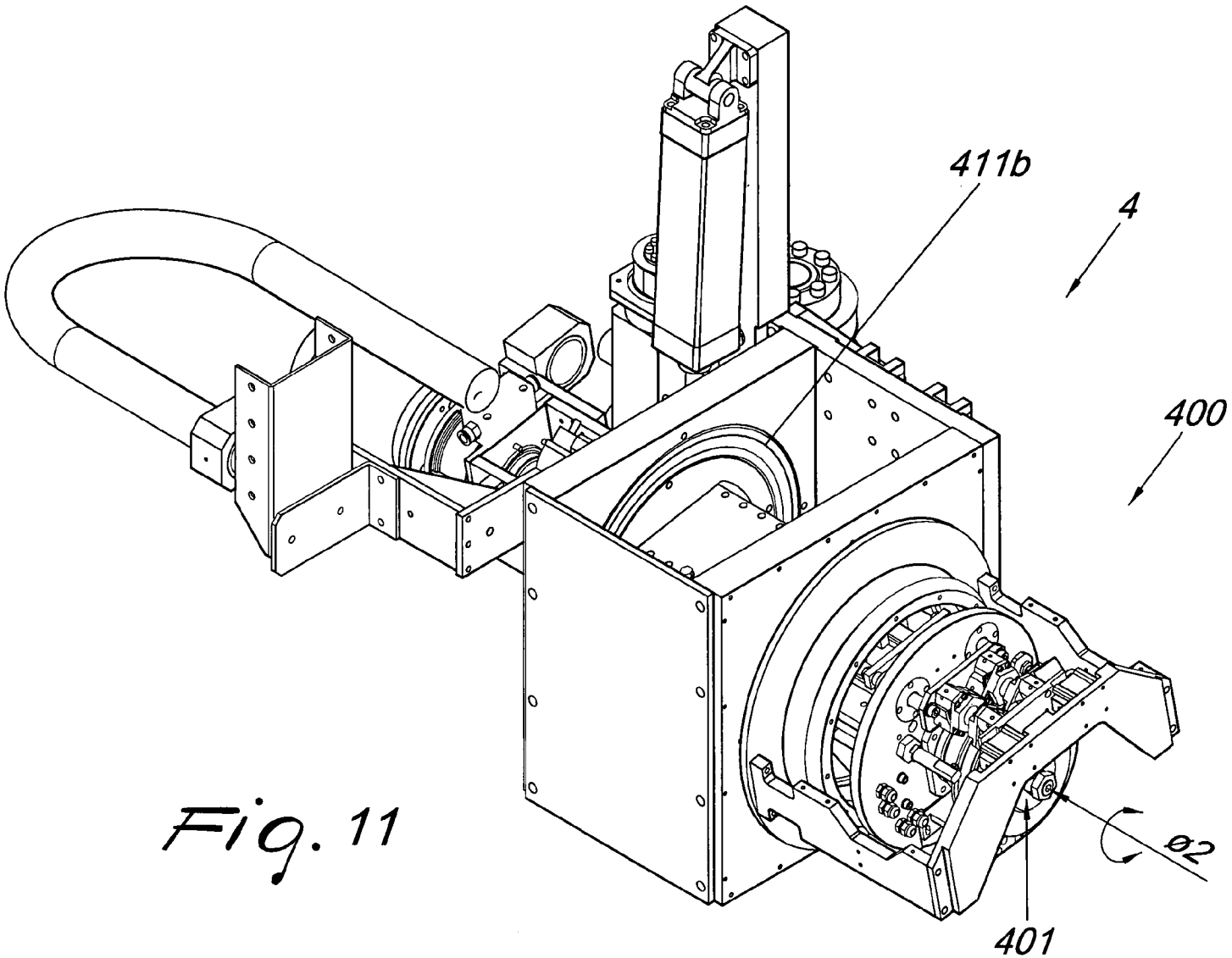
FIG. 11 is a perspective view of the head 400 taken from the opposite side with respect to the controls, i.e., from the working side for arrissing the glass sheet.

With reference to the arrissing station 3, shown together with the station 4 in FIG. 7, the movement on the vertical axis V1 along the vertical post is obtained by means of a truck 302, which is provided with sliders 303, which can move on guides 304 by means of the transmission composed of a screw 305 and a ballscrew 306, said ballscrew being actuated by a pulley 307, by a toothed belt 308, by a pulley 309 and by a synchronous motor 310 (see also FIG. 8). Conveniently, the guides 304 (the corresponding guides 404 are shown in FIG. 7) and the screw 305 are coupled to the vertical post of the machine body 2.

The rotation of the working head comprising a turret 300 for supporting the tool 301 about the axis ø1 is obtained by means of bearings 311*a* and 311*b* accommodated in the truck 302, within which the freely rotating turret is actuated, by means of the transmission composed of a pulley 312, a toothed belt 313 and a pulley 314, by a synchronous motor 315.

Conveniently, limit switches 316*a* and 316*b* limit the angular stroke of said turret in connection with the driving logic of the motor 315.

As regards the movements of the arrissing station 4 along the vertical axis V2, it is possible to repeat the preceding description referred to the arrissing station 3 simply by replacing the first digit 3 with the first digit 4 and considering that the arrangement is mirror-symmetrical so as to utilize conveniently the structure of the machine body 2, in particular of the vertical post, to support the guides 404 and the vertical screw 405.

The rotation of the working head comprising a tool supporting turret 400, in the receptacle of the truck 402, about the axis ø2, differently from what has been described for the tool supporting turret 300, does not require a continuous rotation covering a full circle, but requires a discontinuous rotation which is limited to 90°, as will become better apparent hereinafter from the description of the process, and therefore the mechanical components repeat the type of the turret 300 for supporting the tool 301 as regards only the bearings 411*a* and 411*b*, and instead become a pneumatic actuator 412, conveniently bracketed to the carriage 402, the stem of which has its hinged end rigidly coupled to the tool supporting turret.

Each turret 300, 400 for supporting the tool 301, 401 is composed of a block 318, 418, which is rigidly coupled to a rotating body 317, 417; on said block, slides 319, 419, by means of sliders 320, 420, allow the axial sliding of a plate 321, 421 provided with a motor/spindle 322, 422 and a head 323, 423.

The components known from EPA 1 488 886 in the name of this same applicant, for centering the tool 301, 401 against the rims of the glass sheet are installed, in addition to the tool 301, 401, on the head 323, 423. The axial movements of the head along Z2, Z3 are obtained by means of a ballscrew 324, 424, on which a screw 325, 425 rotates, said screw being coupled by means of a joint 326, 426 to the output shaft of a reduction unit 327, 427 actuated by an asynchronous motor 328, 428. The position of the tool 301, 401 is identified by the signal of a potentiometer 329, 429.

The components known from EPA 1 488 886 consist of the probe 330, 430, the wedge-like shape of which is complementary with respect to the rim of the glass sheet, returning its axial and transverse positions (references with respect to Z1, Z2) by means of the sensors 331, 431 and 332, 432.

Figure 20A:
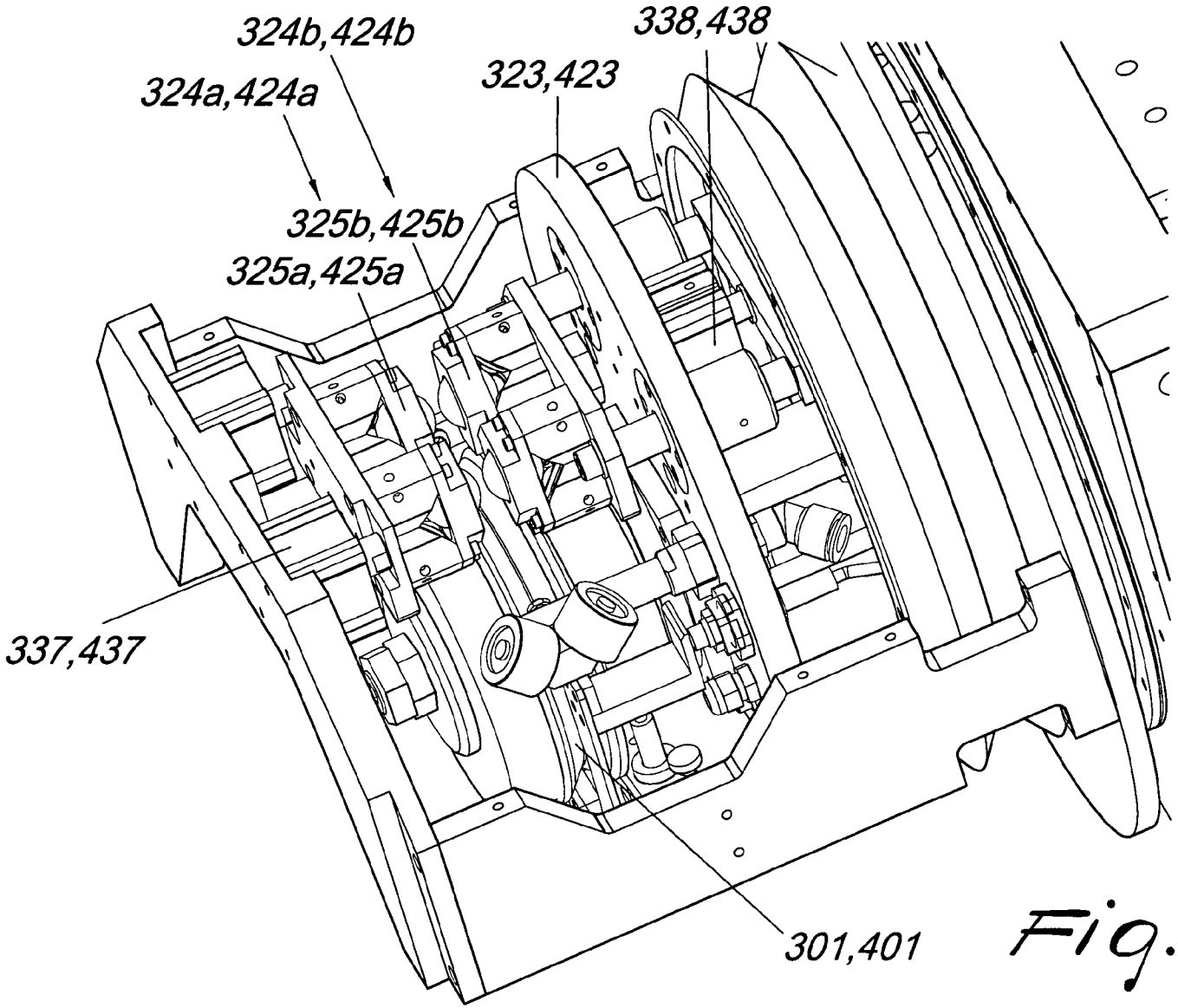
FIG. 20*a* is a perspective view of a detail of the mechanisms for centering the glass sheet.

Further, the heads 323, 423 accommodate mechanisms 324*a*, 424*a* for centering the glass sheet (see FIG. 20) which are arranged opposite with respect to 324*b*, 424*b*; their function is to rigidly couple the position of the glass sheet 1 with respect to the tool 301, 401 by means of mutually opposite ball-bearing sliders 325*a*, 425*a* and 325*b*, 425*b*.

Each of said ball-bearing sliders is constituted by at least one main ball on a bearing of smaller balls, the mutual rolling of which is facilitated by hydraulic or pneumatic lubrication. The mechanisms and the corresponding sliders that operate on the glass sheet face that is directed toward the conveyors 603 (reference of FIG. 2) are moved by actuators 337, 437, which take the larger ball or balls to the level of the stroke limit of the plane 603 during the active step and to a retracted level during the inactive step. The mechanisms and the corresponding sliders that work on the glass sheet face directed toward the head 323, 423 are moved by actuators 338, 438, which take the larger ball or bails to the level of the glass sheet face that is directed toward the head 323, 423, which can vary as a function of the thickness of the glass sheet 1, during the active step and to a retracted level during the inactive step. The expression "active step" is used to reference the step during which there is interaction between the rims of the glass sheet 1 and the tool 301, 401, and the expression "inactive step" is used to reference the step during which the glass sheet is approaching the tool 301, 401 or is in transit.

Figure 20B:
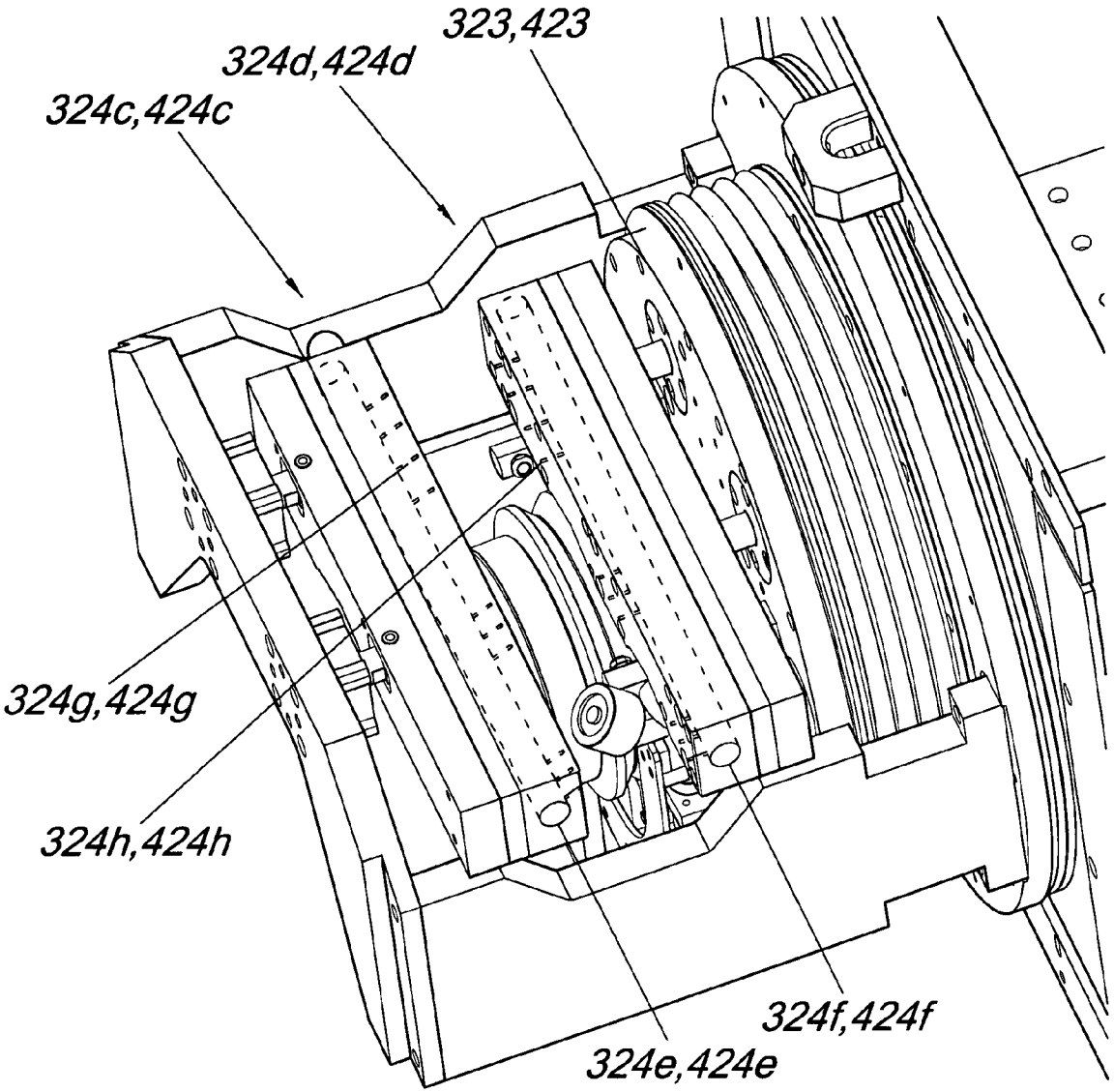
FIG. 20*b* is a perspective view of a detail of an alternative embodiment of the mechanisms for centering the glass sheet.

As an alternative to the solution with centering mechanisms using larger balls on a cradle of smaller balls in the heads 323, 423, it is possible to accommodate glass sheet centering mechanisms such as sliders 324*c*, 424*c* and mutually opposite sliders 324*d*, 424*d* (see. FIG. 20*b*), the function of which is to rigidly couple the position of the glass sheet 1 with respect to the tool 301, 401 by way of a hydrodynamic action obtained by pumping with a pump with a high head (which is known) of a fluid through distribution manifolds 324*e*, 424*e*, 324*f*, 424*f* with ejection through holes 324*g*, 424*g*, 324*h*, 424*h* in order to form a hydrodynamic cushion for centering and supporting the glass sheet 1 between said sliders. This solution, with respect to the previously described one, is particularly adapted for the glass sheets 1 on one or both faces of which there is a coating, for example of the (known) low-emissivity type or of the (known) selective type, which are particularly vulnerable to contact with solid parts. The pump is operated according to the logic of the working cycle and in any case in advance with respect to the insertion of the glass sheet 1 between the sliders 324*c*, 424*c*, 324*d*, 424*d*.

The working heads 300 and 400 comprise an abrasive tool 301, 401, typically shaped like a diamond grinding wheel with a V-shaped profile, by means of which both perimetric face edges of the glass sheet 1 are ground. The grinding wheel tool 301, 401 is connected to a coaxial motor 322, 422, which produces the rotary cutting motion.

As is known from EPA 1 488 886, the tool bodies 300, 400 further comprise a probe 330, 430, which is mounted on a laminar arm, which in turn is pivoted to the tool body by means of a pivot and is further connected to the tool body by means of a pneumatic cylinder. The probe is preferably a wheel, which duplicates substantially the same shape and thickness as the grinding wheel tool 301, 401 although it has a smaller radial dimension than the grinding wheel.

The working heads 3, 4 comprise advantageously, on the plate 321, 421, a support, not shown in the figures because it is known, for adjusting the inclination of the tool 301, 401 with respect to the plane of the glass sheet. In particular, it is preferred to adjust this inclination so that linear contacts, rather than point contacts, are produced between the tool 301, 401 (of the biconic or pseudo-biconic type) and the edges of the glass sheet, with a consequent improved cutting action of the tool and reduced wear of said tool. Adjustment of the tool is performed for example by interaction between screws and slots.

Figure 14A:
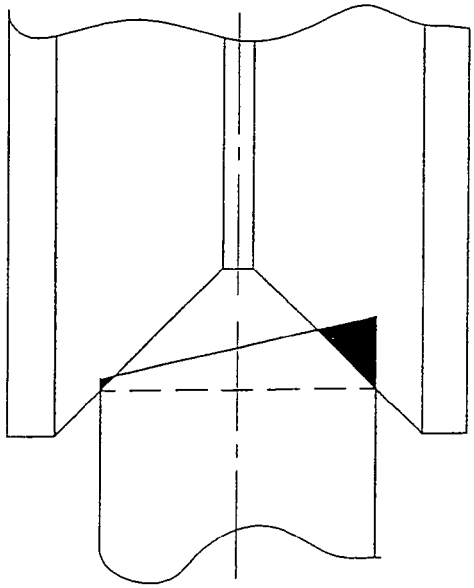
FIGS. 14*a* and 14*b* are schematic, partial views showing the mutual arrangement of the grinding wheel and of a single glass sheet, respectively when the position of the sheet is not controlled but there is simply a centering on the central axis thereof, and when this control is provided.
Figure 14B:
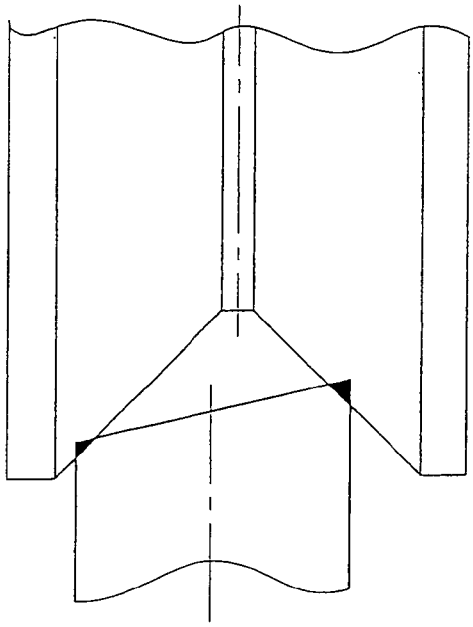
Figure 15A:
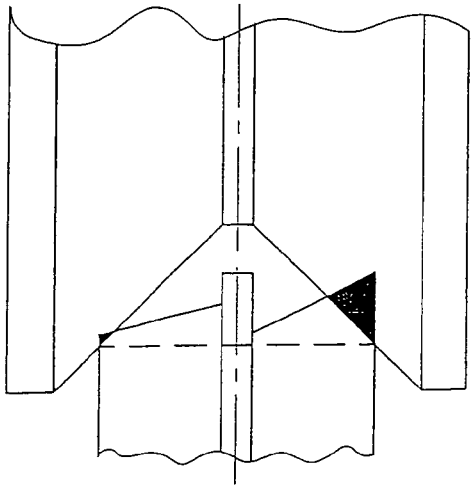
FIGS. 15*a* and 15*b* are schematic, partial views showing the mutual arrangement of the grinding wheel and of a laminated glass sheet, respectively when the position of the sheet is not controlled but there is simply a centering on the central axis thereof and when this control is provided.
Figure 15B:
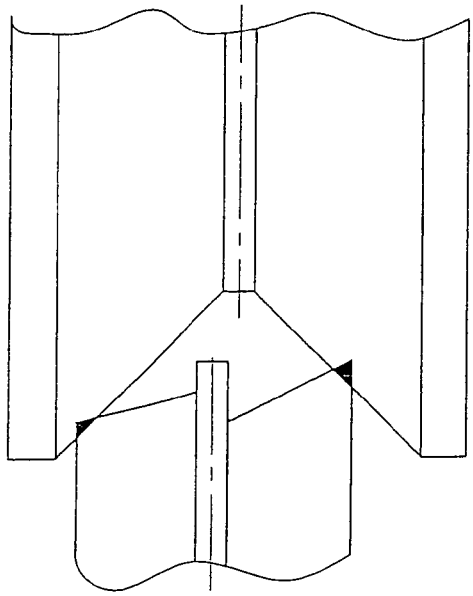
Figure 16:
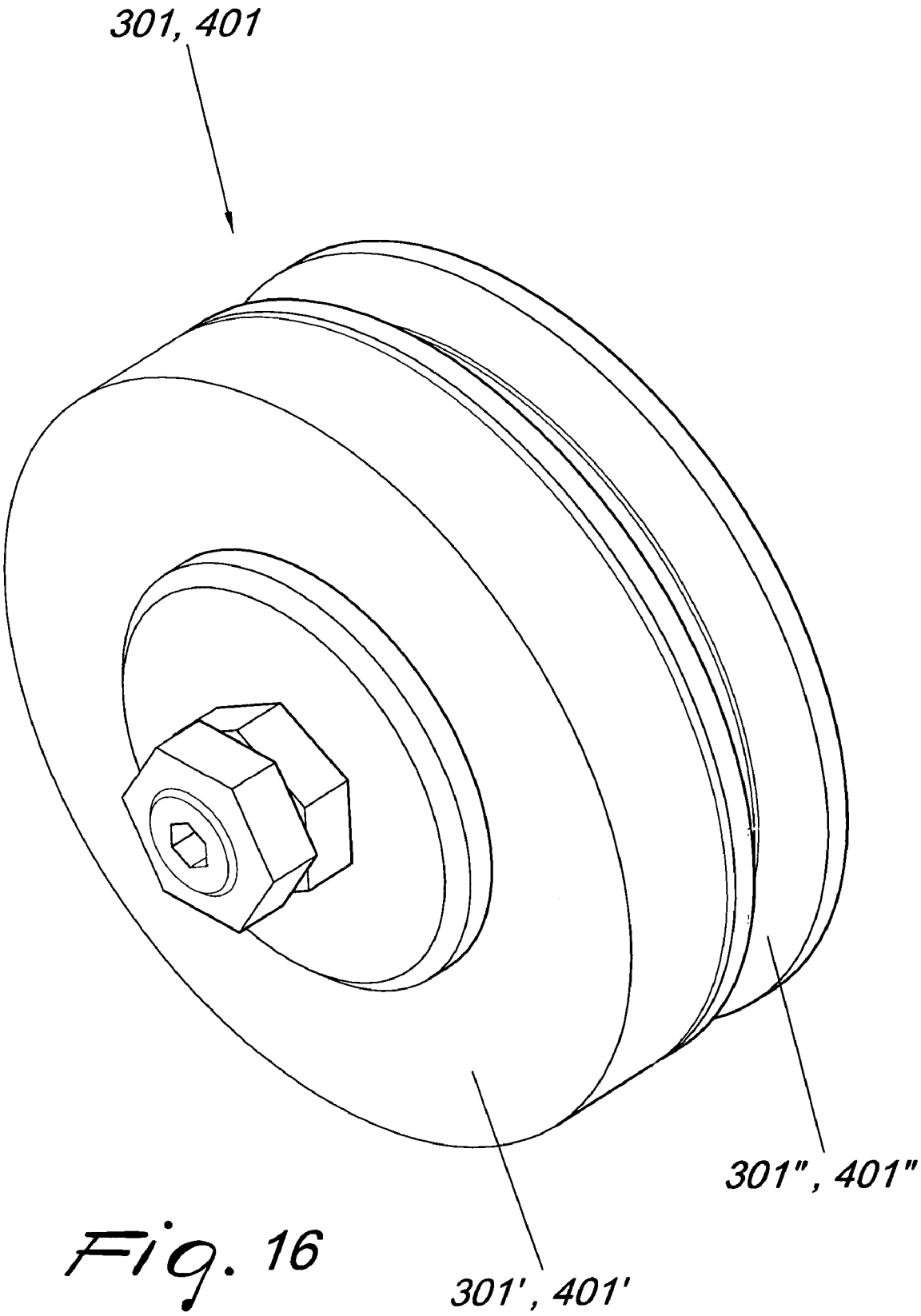
FIG. 16 is a perspective view of a grinding wheel used for particular treatments considered in the description.

The working heads 300, 400 are moved along the peripheral region of the glass sheet by means of the controllers of the PID type of the synchronous motors, so as to produce arrissing along the entire perimeter of the glass sheet. Arrissing occurs advantageously symmetrically on both face edges of the glass sheet 1, as shown in FIGS. 14*b* and 15*b*, because the probe tends to adapt to the edge of the sheet, sliding transversely with respect to the plane of the sheet due to the pressure applied by the cylinder so that both face edges of the sheet are in contact with the internal surface of the probe. In this manner, the effect of asymmetric beveling, that would occur by centering perfectly the groove of the tool with the centerline of the edge of the glass sheet, as shown in FIGS. 14*a* and 15*a*, is avoided.

As is known, control of the PID type allows optimum adjustment of the process, since if x is the offset of the value to be controlled (in the specific case, the distance between the sensors 331, 431, 332, 432 and the plates that belong to the probe) that one wishes to return to the set value (in the specific case, zero), the motorized actuation means that restore the set situation act with a power which is proportional to:

the linear value x (movement), its derivative over time (speed), its integral over time, allowing to attenuate the minimal set variations that are not eliminated completely with the two preceding actions.

Moreover, the proportionality bands can be set in appropriate intervals.

Said control system can be performed with the functions provided by the programmable logic controller, which is advantageously of the PLC type, and is particularly necessary to avoid phenomena of instability, resonance, vibration and drift that would tend to trigger autonomously if the contact between the abrasive tool and the glass sheet associated with the cutting and feed motions of the tool 301, 401 were not properly and dynamically controlled in terms of physical value.

Having described all the essential components of a preferred embodiment of the machine, its working process is now described in the following options, all of which are possible by using the described mechanisms, a logic system for controlling them and a software for managing said logic system:

OPTION 1: working a rectangular glass sheet 1

OPTION 2: working a rectilinear-contour glass sheet 1'

OPTION 3: working a mixed-contour glass sheet 1"

OPTION 4: working a curved-contoured glass sheet 1'"

OPTION 5: combination of the machine according to EPA 1 488 886 with the machine according to the present invention for working the perimeter of the glass sheet not only on the face edges but also on the end faces, where the expression "end faces" designates the shorter faces of the glass sheet 1, which is considered as a parallelepiped, i.e., the faces that lie in the direction of thickness.

All the descriptions resume from the position, already described, in which the glass sheet (1, 1', 1") stops at the stop sensor 510, which interacts with the logic system that controls the motors 508*a*, 508*b* and 522, the succession of the steps up to this condition being common. For the case in which the first side 1*a* of the glass sheet 1 is not vertical (a case which is possible for the embodiments 1' and 1" and is always present for the embodiments 1'", see the dashed lines in FIG. 23), stopping in the work start position is not determined by the sensor 510 but by a software which, according to the shape of the glass sheet 1', 1" or 1'", interacts directly with said motors.

The process for arrissing the longitudinal face edges that constitute the perimeter of the glass sheet performed by the tools 301 and 401 is assumed to be known, since it is derived from EPA 1 488 886, to which reference is made for the details, particularly as regards the operation of the probe and the corresponding feedback circuits, by means of the sensors 331, 431, 332, 432 and the potentiometer 329, 429 on the motor 328, 428.

OPTION 1: the tool 301, actuated by the motor-spindle 322, travels along the glass sheet 1 on its vertical side 1*a* up to the face edge Sab, at which, by way of the action of a sensor, not shown, which is contained in the head 323 and interacts with the synchronous motor 310, which now acts as a non synchronous motor, the truck 302 stops its vertical stroke along the axis V1 and the head 323 performs a 90° rotation by means of the synchronous motor 315; which now acts as a non-synchronous motor. Accordingly, the tool 301 remains stationary at the upper horizontal side 1*b* of the glass sheet 1 and the glass sheet 1 is moved along the horizontal axis H by way of the action of the synchronous motors 508*a*, 508*b* and 522, all of which act as non synchronous motors (synchronization of the axes H and V1 is not necessary, since the movements along these axes for the case of the rectangular glass sheet 1 are independent), so that the upper horizontal side is arrissed. In relation to the length of the glass sheet, during this motion along the axis H, the face edge Sca of said sheet may reach the position of the range of action of the tool 401, which is stationary in its inactive position. In this case, the tool 401, actuated by the motor-spindle 422 activated by a sensor which is not shown and accommodated in the head 423, begins its action toward the lower horizontal side 1*c*. Then, as a function of the length of the glass sheet, the following situations can occur: the tools 301 and 401 interact simultaneously respectively with the sides 1*b* and 1*c* of the glass sheet 1, or the tool 301 completes the working of the horizontal upper side 1*b* before the tool 401 begins its working of the horizontal lower side 1*c*. When the tool 401 has completed working the side 1*c*, in a manner similar to what has occurred for the head 323, the head 423, at the face edge Sdc, rotates through 90° by way of the action of the pneumatic actuator 412, the axis H is stopped and the axis V2 is activated by way of the intervention of the synchronous motor 410, which now acts as a non-synchronous motor, so that the tool 401 proceeds with the working of the rear vertical side 1*d* until it reaches the face edge Sbd. The glass sheet 1 then continues its stroke along the axis H to be transferred to the conveyor 6*b*. At this point, or possibly slightly earlier for the tool 301, the tools 301, 401 return to their inactive lower stroke limit positions in order to be ready to work the next sheet.

Having described in detail option 1, the description can be more concise for the subsequent options, since it becomes intuitive by considering FIG. 23 and the already detailed preceding explanations regarding the operation of the axes H, V1, V2, ø1, ø2.

OPTION 2: Everything proceeds as in the description of option 1, except that in order to follow the inclination of certain sides, for example 1*b*, which are not horizontal or not vertical, the axes H and V1 operate interpolated by means of the concatenated actuation of the motors 508*a*, 508*b*, 552 and 310, which now operate synchronously. The concatenation of these motors occurs by way of electronic actuations managed by software which has received as inputs all the information related to the shape 1' of the glass sheet, by means of known methods such as bar codes, databases, etc. The lower side, which for these shapes must be horizontal, is instead worked non synchronously by the tool 401 while the glass sheet 1' moves along the axis H.

OPTION 3: Everything proceeds as in the description of option 1, except that in order to follow the inclination of certain sides, for example 1*b*, which are not horizontal or not vertical and the curved shape of some other sides, the axes H and V1 act interlaced by means of the concatenated actuation of the motors 508*a*, 508*b*, 522 and 310, which now operate synchronously, in the case of the straight sides, while the axes H, V1 and ø1 operate interpolated by means of the concatenated actuation of the motors 508*a*, 508*b*, 522, 310 and 315, which now operate synchronously. The concatenation of these motors occurs by way of electronic actuations managed by software, said software having received as inputs all the information related to the shape 1" of the glass sheet, by means of known methods such as bar codes, databases, etc. The lower side, which for these shapes must be horizontal, is instead worked non synchronously by the tool 401 while the glass sheet 1" moves along the axis H.

OPTION 4: for this option, only the station 3 is active and the glass sheet is supported and conveyed exclusively by at least one of the suckers 512, 513 and the interpolated axes H, V1 and ø1 are actuated exclusively by the motors 522, 310 and 315.

For OPTIONS 3 and 4, since the mechanisms for centering the tool 301 and for fine correction of the relative path of the tool/edge of the glass sheet (by means of the sensors 331, 332) can no longer be actuated by means of the probe known from EPA 1 488 886, since the curved shape does not allow to keep the tool and the probe in contact with the edge of the glass sheet, the following solutions are used: centering of the tool along the axis Z1 is performed on the centerline of the thickness, on the basis of the measurement made by the device 604; fine adjustment of the relative path of the tool/glass sheet edge is performed by measuring the absorption of the motor-spindle 322 and feeding back said signal toward the motors that control the axes H and V1 so that the tool moves away from the edge of the glass sheet if absorption becomes excessive and instead approaches it if absorption drops below nominal, nominal being the value that corresponds to the removal of material to perform the symmetrical beveling of the intended size. It is understood that this solution is applicable only if the edge of the glass sheet, as obtained from the scoring and breakage operations, is not too oblique in the direction of the thickness of the glass sheet.

Another method for the approach and adjustment of the contact of the tool with the edge of the glass sheet is obtained by oscillating the head about an axis ø3, ø4 which is parallel to the face edges of the side of the glass sheet, although said axis does not coincide with any of said face edges. The device for performing this method, which operates in addition to the existing ones, such as the ones operating along the axes V1, V2 and H and the ones that operate along the axes Z1 and Z2, connected to the probe 330, 430, described earlier, is composed of: the pivots 333*a*, 333*b*, 433*a*, 433*b* which identify an oscillation axis ø3, ø4, the damping unit 334, 434, the pneumatic cylinder 335, 435. If F is the actuating force (the force determined by the irregularities of the profile of the glass sheet), J is the moment of inertia of the masses involved in the oscillation related to the oscillation axis ø3, ø4, c is the constant of the damping unit 334, 434, k is the elastic constant of the cylinder 335, 435, the equation that rules the motion of this approach becomes: $F=J\,d^2Ø/dt^2+c\,dØ/dt+kØ$.

By means of the adjustment of the parameters c and k, based on the feedback of the sensor 336, 436, it is therefore possible to achieve soft approach and contact of the tool 330, 430 toward the edge of the glass sheet 1 and therefore absorb its irregularities without affecting said edge with dangerous loads which otherwise might entail the breakage of the glass sheet or in any case irregular working.

OPTION 5: this is an equally inventive option, to the point of deserving an independent claim both as a machine and as a method, and derives from combining the machine according to EPA 1 488 886 with the machine according to the present invention, in order to provide a method for grinding rectangular glass sheets 1, which up to now in the background art has always occurred by arranging the glass sheet on a horizontal plane. The resulting advantages are a reduction of the space occupation of the overall machine, together with the ones described earlier of the shape of the machine according to the present invention.

Figure 21:
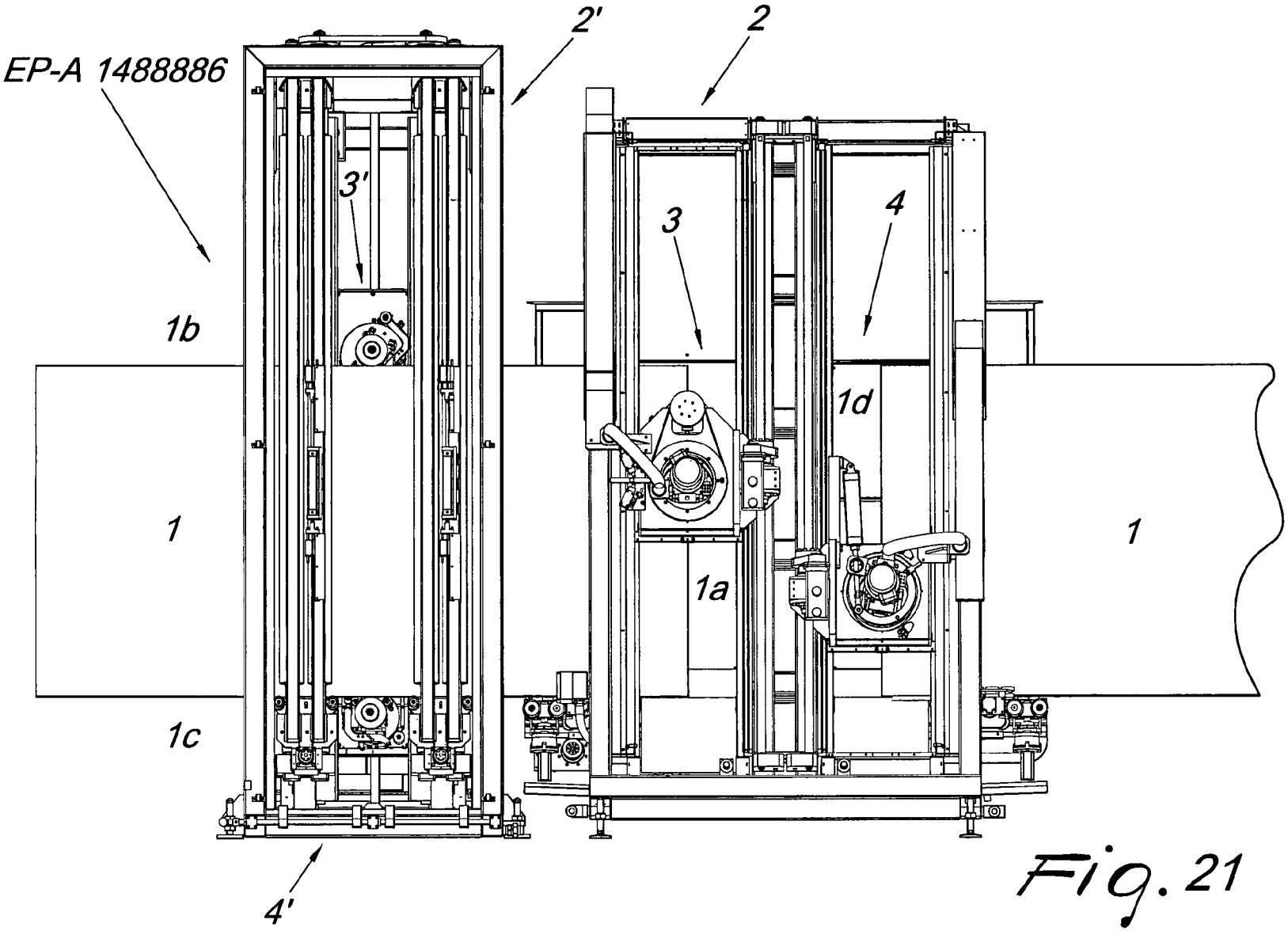
FIG. 21 is a front view showing a claimed combination of the machine according to the present invention with the machine according to EPA 1 488 886, both for the execution of arrissing limited to edge grinding and for performing particular arrissing and grinding processes.

Traditional machines in fact, in addition to being bulky in that they are arranged so as to have a horizontal glass sheet layout, are also bulky due to their configuration of arranging in total four working heads, which contain tools such as 801, 802, 803 etc, in pairs on bridges for the simultaneous working of the opposite sides 1*a*, 1*d* and 1*b*, 1*c* of the rectangular glass sheet 1, with the consequence of requiring considerable footprints especially for working the furthest opposite sides, since the size of the glass sheet to be worked may reach 6000×3210 mm. As is evident from FIG. 21, which combines the two inventions of this same applicant (EPA 1 488 886 in the left part and the machine according to the present invention in the right part), in addition to the advantage of reduction of the space occupation of the bridges, each containing the pair of tools, since they are arranged vertically, it can be seen that in the right part the bridge that contains the two heads for working the furthest mutually opposite sides does not have the space occupation that corresponds to the long side of the glass sheet but only the space occupation required to contain the two heads, since the working of the furthest short sides of the glass sheet does not occur simultaneously in the sheet currently being worked but on the rear side of the sheet of the preceding process and on the front side of the sheet currently being worked. It goes without saying that the first machine stops briefly during the working of the horizontal sides, moving the tools of the stations 3' and 4' slightly away from the rim of the glass sheet by means of axes such as H, when the axis H1 is working the front side 1*a* of the sheet currently being worked, and resumes as soon as the side 1*a* has been completed, while the working of the rear vertical side 1*d* of the sheet of the preceding process entails no interruption.

Figure 22A:
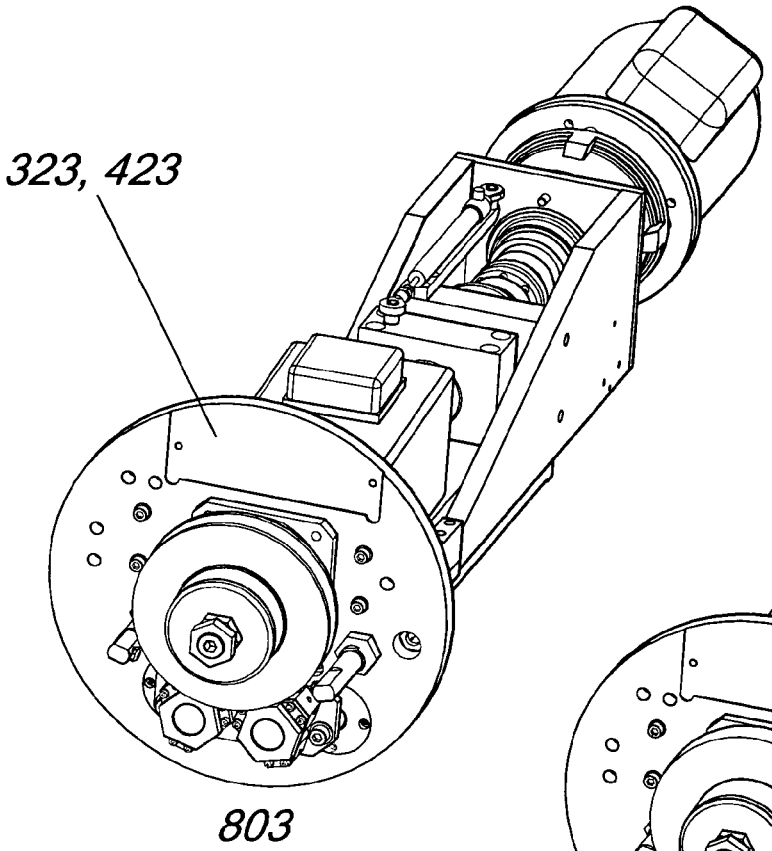
FIGS. 22*a*-22*c* are perspective views showing the types of the working heads adapted to perform particular arrissing and grinding processes.
Figure 22B:
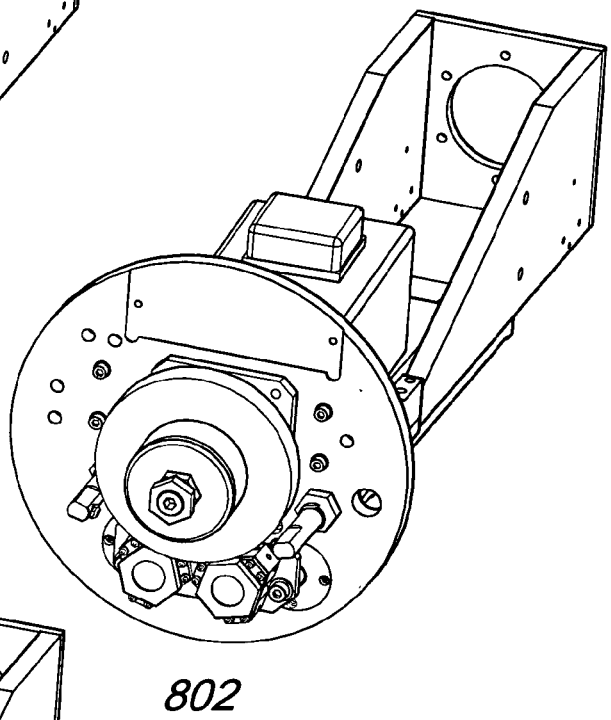
Figure 22C:
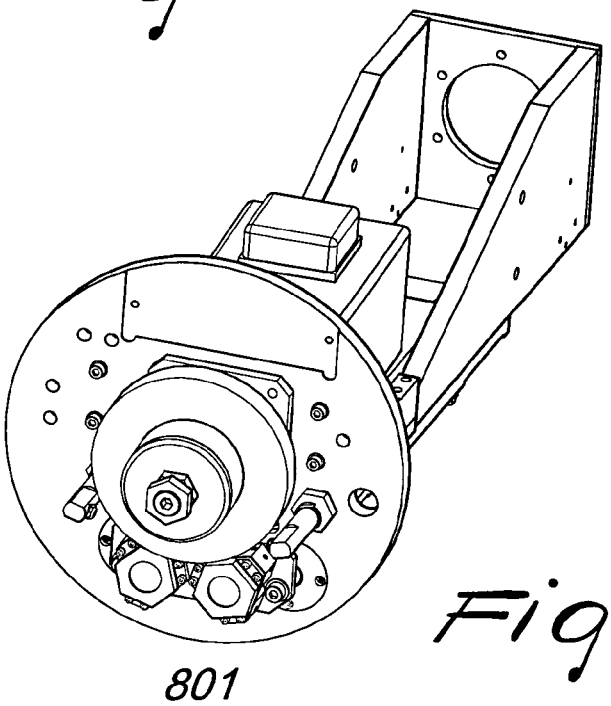
Figure 23A:
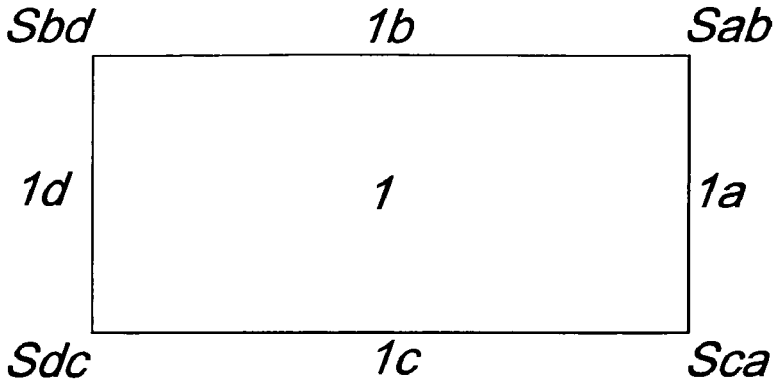
FIGS. 23*a*-23*d* are views showing various shapes of the glass sheets that can be worked with the machines and the methods according to the present invention.
Figure 23B:
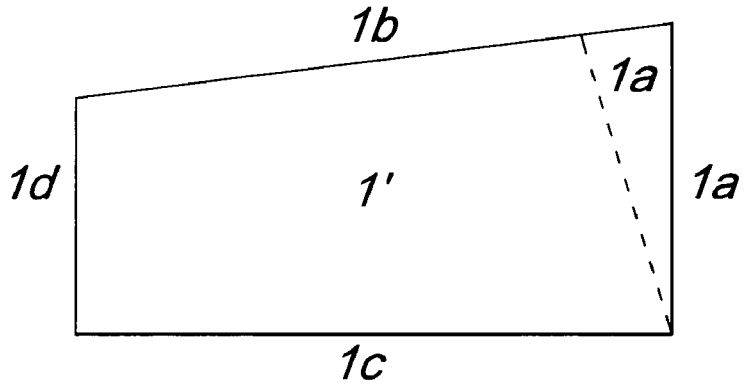
Figure 23C:
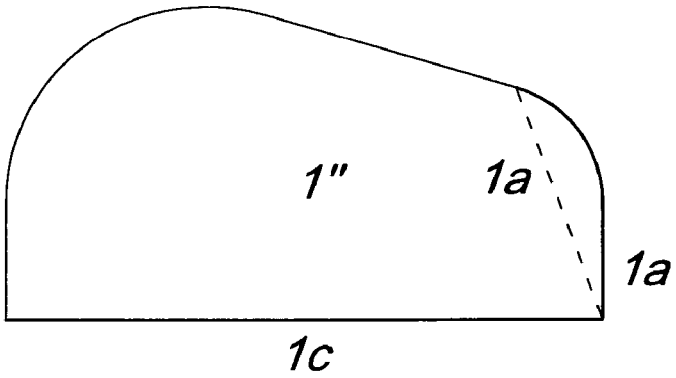
Figure 23D:
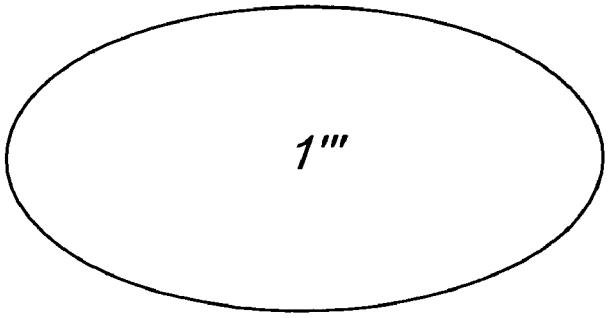

Conveniently, the heads of the machines in option 5 can contain several tools, as shown in FIG. 22, for example 801, which performs the rough grinding of the edge of the glass sheet on its entire thickness, 802 which performs the finishing grinding of the edge of the glass sheet on its entire thickness, 803 which performs arrissing for beveling. It goes without saying that the tool 803 no longer requires the probe such as 330, 430, since the rims of the glass sheet have been squared by the preceding work of the tools 801 and 802 and therefore centering can occur on the basis of the signal that arrives from the thickness measurement device 604, but nothing forbids keeping it. It is also understood that the tools such as 801, 802, 803, by always working on horizontal or vertical straight lines, are not limited in their quantity, and therefore are described as "at least one", their type and quantity being linked to the shape and finish of the profile of the edge to be obtained.

The descriptions given above refer to edge grinding machines or combined machines as in option 5, in which the original machine (for example an edging machine) is arranged to the left and the destination machine (for example a washing unit) is arranged to the right of said machine according to the present invention. It is easy to imagine the description and the corresponding figures in the case of mirror-symmetrical or otherwise different arrangements.

All the movements linked to the steps of the cycle are of course mutually interlocked with the aid of a parallel but always-active logic system in order to prevent, during the process, conditions of mutual interference among actuation elements, tools and material being worked.

It is evident that industrial application is an assured success, since machines for arrissing a glass sheet are currently not very widespread. Moreover, the market of double glazing units is expanding continuously, and in recent years it has been increased by all the configurations that require the use of special glass sheets, such as the ones described in the introduction (and in particular tempered ones which require arrissing as a preparatory step for tempering), therefore the beveling of the face edges constitutes a very important added value which qualifies the product. Moreover, the spread of shapes other than rectangular, since they are polygonal or curved or mixed, increases further the importance of the present invention in contrast with the limitation of traditional machines, which can only work rectangular shapes.

The particular arrangement of the stations of the machine according to the present invention has further substantially halved cycle times with respect to EPA 1 488 886.

Moreover, one sector which is developing continuously and also requires arrissing of the face edges or of the entire perimetric contours of the glass sheets 1 is constituted by glass tempering in many applications which are different from those of the double glazing unit sector. For this application, the machine can assume a vertical or horizontal arrangement.

Moreover, the considerable space occupation of machines for the most complete working of the edges of glass sheets (not only for arrissing), known as "bilateral", which operate by arranging the glass sheet 1 horizontally, certainly encourages the development of machines according to OPTION 5, which currently do not exist commercially.

It has been shown, therefore, that the machine and machines according to the invention achieve the intended aim and objects. The invention is susceptible of numerous modifications and variations, all of which are within the scope of the appended claims. Thus, for example, the mechanical solutions for the motions for feeding the tools, supporting and moving the glass sheet and the actuation means can be electrical, electrical and electronic, pneumatic, hydraulic and/or combined, while the control means can be electronic or fluidic and/or combined.

An important alternative embodiment is the one constituted by the logic combination of the actuations respectively for translational motion of the glass sheet, for moving the working heads and for timing the inclination of the tool so as to allow the working of the contoured glass sheets, i.e., sheets having non rectangular shapes. To achieve this, as described earlier, the electrical actuations of the motors dedicated to the axes H, V1, V2, ø1 and ø2 are concatenated by means of an electrical axis with numeric control.

Moreover, the tools 301 and 401 can have a shape other than biconic or can be distributed in such a quantity as to work not only on the face edges of the glass sheet but also on the complete face of the perimeter in order to arriss not only the sharp face edges but also the band like region between them, so as to eliminate defects, dust, contamination, etc. For example, the diamond grinding wheel can have a profile other than the V-shaped or biconic one.

Figure 12A:
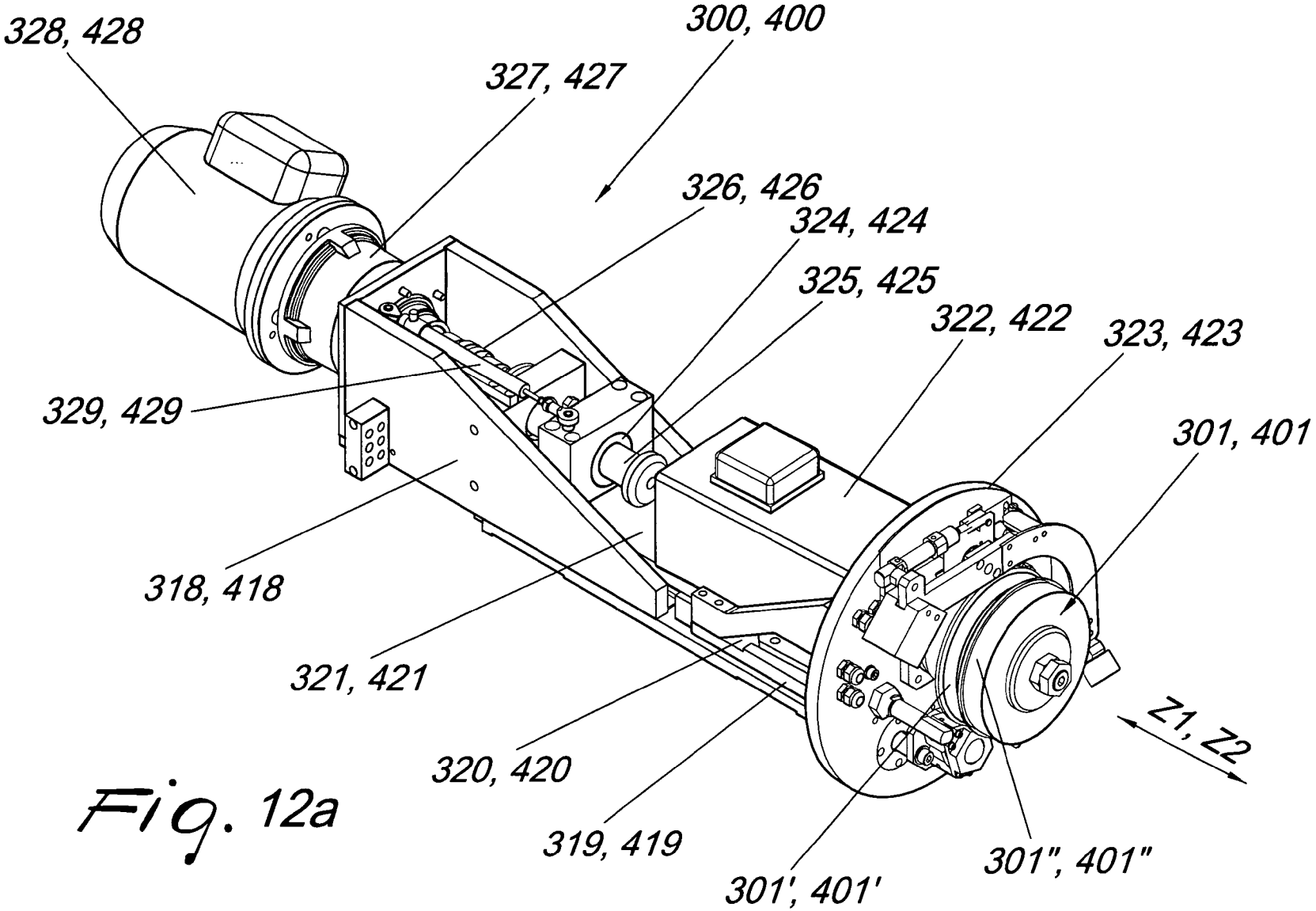
FIG. 12*a* is a perspective view equally of the heads 300 or 400 in a condition in which the actuation system of the tool for its cutting motion and the mechanisms for actuating axial movement along the axes ø1 or ø2 are visible.
Figure 12B:
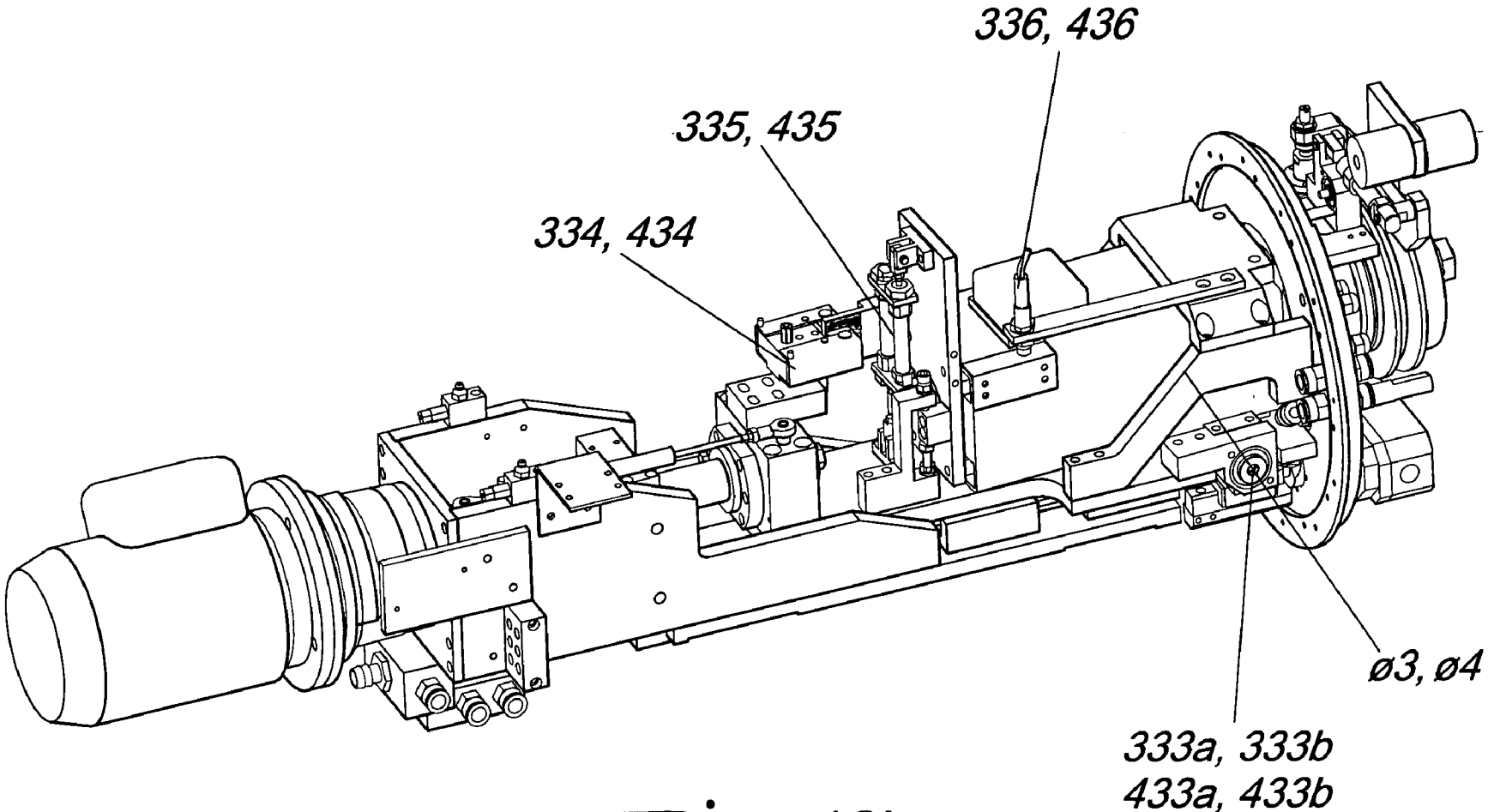
FIG. 12*b* is a perspective view of another method of approach and adjustment of the contact of the tool with the edge of the glass sheet, obtained by tilting the head about an axis which lies parallel to the edges of the side of the glass sheet but does not coincide with any of said edges.
Figure 13:
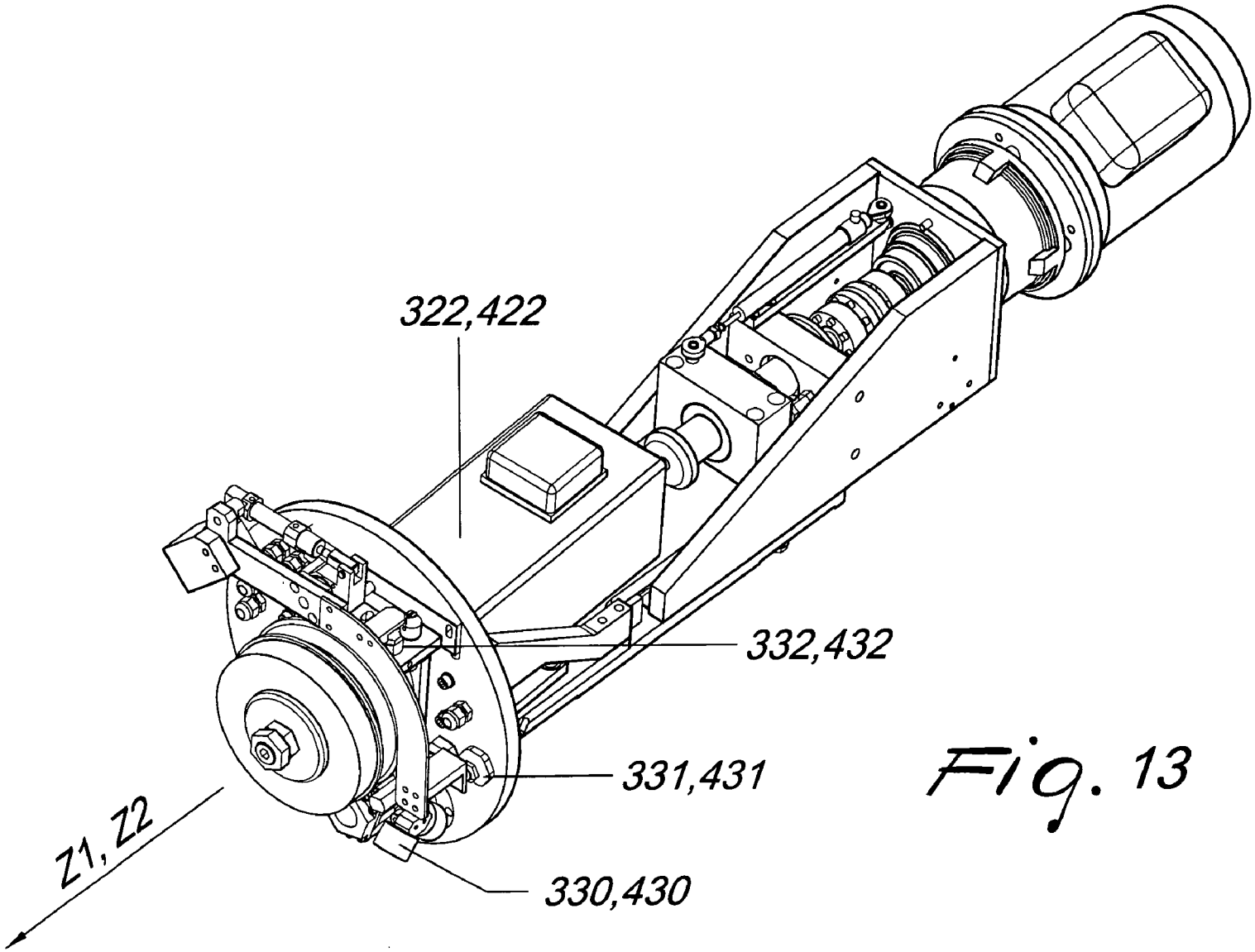
FIG. 13 is a perspective view equally of the heads 300 or 400 in a condition in which, in addition to what has been shown in FIG. 12*a*, the probe mechanism for axial centering of the heads performed along the axes Z1 or Z2 is shown.

The tool body may of course mount interchangeable tools for this purpose, or the grinding wheel can have a profile which comprises two adjacent sections, the first one 301', 401' with a frustum-shaped or V-shaped profile and the second 301", 401" which is cylindrical, as shown in FIG. 12*a*. In this case it is possible to bevel the face edges and grind the surface comprised between said face edges without resorting to the combination of machines as in FIG. 21 but simply by moving transversely the grinding wheel with respect to the sheet 1 so as to use the portion having a V-shaped profile or a cylindrical profile respectively.

Moreover, in view of the above description it is straightforward to understand that by using cylindrical grinding wheels in the arrissing operations it is possible to bevel the face edges (Sab, Sbd, Sdc, Sca) that join the two faces of the sheet (see also EPA 1 488 886).

The constructive details may be replaced with other technically equivalent ones. The materials and the dimensions may be any according to requirements, in particular those arising from the dimensions (base and height) of the glass sheets 1.

The disclosures in Italian Patent Application No. TV2005A000145 from which this application claims priority are incorporated herein by reference.

What is claimed is:

1. An automatic machine for arrissing edges of a glass sheet which is substantially flat and arranged in a vertical plane, comprising:

a machine body;

at least two working stations mounted on said machine body, so as to come into contact with edges of said sheet and to move with respect to said sheet along a perimeter thereof; said at least two working stations each comprising a working head which is movable transversely to the vertical plane of said sheet; said working head comprising an abrasive tool of a grinding wheel type for performing arrissing, and at least one probe arranged upstream of a work area of said abrasive tool with respect to a direction of relative advancement of said tool with respect to said sheet so as to come into contact with the sheet edge being worked before said abrasive tool; said working head further comprising sensors which are adapted to detect a relative movement between said at least one probe and said abrasive tool due to local misalignment between the sheet edge being worked and said abrasive tool;

a machine controller for receiving feedback signals from said sensors;

actuation means controlled by said controller in response to said feedback signals, for adjusting mutual arrangement of said abrasive tool with respect to the sheet edge being worked;

a vertical post of said body; and wherein the working heads comprise a first working head and a second working head which are both arranged and movable vertically on said vertical post, said first working head being movable vertically in opposite directions along a first vertical axis, said second working head being movable in opposite directions along a second vertical axis, said first vertical axis and said second vertical axis being mutually independent and distally arranged from each other at opposite sides of said vertical post.

2. The machine of claim 1, wherein the working heads contain each a device for centering and guiding the glass sheet which is composed of respective, mutually opposite centering mechanisms.

3. The machine of claim 1, wherein said abrasive tool is a diamond grinding wheel.

4. The machine of claim 3, wherein said diamond grinding wheel is of a biconic type, so as to bevel symmetrically along each edge of said glass sheet both face edges thereof.

5. The machine of claim 3, wherein said diamond grinding wheel comprises a cylindrical portion and a biconic portion, so as to arriss edges of said glass sheet or grind face edges thereof depending on which portion of said grinding wheel faces said edges.

6. The machine of claim 1, wherein said working head comprises a support for adjusting an inclination of said abrasive tool with respect to said vertical plane of said sheet.

7. The machine of claim 1, wherein said machine body is provided extended in a substantially vertical direction, so as to allow insertion of said machine body in a line for working glass sheets which are arranged in said vertical position.

8. The machine of claim 1, wherein said sheet is arranged on a conveyor to move along a substantially horizontal direction.

9. The machine of claim 1, wherein the approach and adjustment of the contact of the tool with the edge of the sheet is controlled by a control of an absorption of the motor.

10. An automatic machine for arrissing edges of a glass sheet which is substantially flat and arranged in a vertical plane, comprising:

a machine body;

at least two working stations mounted on said machine body, so as to come into contact with edges of said sheet and to move with respect to said sheet along a perimeter thereof; said at least two working stations each comprising a working head which is movable transversely to the vertical plane of said sheet; said working head comprising an abrasive tool of a grinding wheel type for performing arrissing, and at least one probe arranged upstream of a work area of said abrasive tool with respect to a direction of relative advancement of said tool with respect to said sheet so as to come into contact with the sheet edge being worked before said abrasive tool; said working head further comprising sensors which are adapted to detect a relative movement between said at least one probe and said abrasive tool due to local misalignment between the sheet edge being worked and said abrasive tool;

a machine controller for receiving feedback signals from said sensors;

actuation means controlled by said controller in response to said feedback signals, for adjusting mutual arrangement of said abrasive tool with resect to the sheet edge being worked;

a vertical post of said body;

the working heads being arranged and being movable vertically along independent axes and in opposite manners on said vertical post;

the working heads containing each a device for centering and guiding the glass sheet which is composed of respective, mutually opposite centering mechanisms; and said devices for centering and guiding the glass sheet composed of mutually opposite centering mechanisms being provided, in each part thereof in contact with the glass sheet, with at least one main, larger ball which is freely movable on a cradle of smaller balls.

11. The machine of claim 10, wherein the devices for centering and guiding the glass sheet have an end part in contact with the glass sheet, which is lubricated with pressurized fluids selected among water, air and not noxious gases, so as to allow components thereof to slide in contact with the glass sheet.

12. The machine of claim 11, wherein the devices for centering and guiding the glass sheet are composed of sliders for each of said working heads, said sliders being provided respectively with distribution manifolds and ejection holes through which a pump actuated fluid with a high head is propelled against the glass sheet so as to constitute a hydrodynamic cushion for centering and supporting said glass sheet.

13. The machine of claim 11 comprising: a lubrication and cooling system, whereby said sensors operate in a wet environment due to water flushing from the lubrication and cooling system; and an enclosure for protecting said sensors and which is flushed with air or gas in overpressure.

14. An automatic machine for arrissing edges of a glass sheet which is substantially flat and arranged in a vertical plane, comprising:

a machine body;

at least two working stations mounted on said machine body, so as to come into contact with edges of said sheet and to move with respect to said sheet along a perimeter thereof; said at least two working stations each comprising a working head which is movable transversely to the vertical plane of said sheet; said working head comprising an abrasive tool of a grinding wheel type for performing arrissing, and at least one probe arranged upstream of a work area of said abrasive tool with respect to a direction of relative advancement of said tool with respect to said sheet so as to come into contact with the sheet edge being worked before said abrasive tool; said working head further comprising sensors which are adapted to detect a relative movement between said at least one probe and said abrasive tool due to local misalignment between the sheet edge being worked and said abrasive tool;

a machine controller for receiving feedback signals from said sensors;

actuation means controlled by said controller in response to said feedback signals, for adjusting mutual arrangement of said abrasive tool with respect to the sheet edge being worked;

a vertical post of said body;

the working heads being arranged and being movable vertically along independent axes and in opposite manners on said vertical post; and said working heads consisting each of a turret which is rotatable about an axis thereof and by an actuator selected from a motor and a pneumatic actuator adapted to turn the rotatable turrets with respect to a containment truck, allowing rotation of the turrets about respective axes which are substantially perpendicular to said vertical plane of said sheet, said actuator being controlled by the machine controller to turn a tool body contained in the turrets depending on a glass sheet edge position and shape and depending on a non-rectangular shape of the glass sheet to be ground or arrissed.

15. An automatic machine for arrissing edges of a glass sheet which is substantially flat and arranged in a vertical plane, comprising:

a machine body;

at least two working stations mounted on said machine body, so as to come into contact with edges of said sheet and to move with respect to said sheet along a perimeter thereof; said at least two working stations each comprising a working head which is movable transversely to the vertical plane of said working head comprising an abrasive tool of a grinding wheel type for performing arrissing, and at least one probe arranged upstream of a work area of said abrasive tool with respect to a direction of relative advancement of said tool with respect to said sheet so as to come into contact with the sheet edge worked before said abrasive tool; said working head further comprising sensors which are adapted to detect a relative movement between said at least one probe and said abrasive tool due to local misalignment between the sheet edge being worked and said abrasive tool;

a machine controller for receiving feedback signals from said sensors;

actuation means controlled by said controller in response to said feedback signals, for adjusting mutual arrangement of said abrasive tool with respect to the sheet edge being worked;

a vertical post of said body;

the working heads being arranged and being movable vertically along independent axes and in opposite manners on said vertical post; and the machine further comprising a damping unit and an actuation cylinder, approach and adjustment of tool contact with an edge of the sheet being controllable by way of the probe and by oscillation, which is damped by way of the damping unit, which is actuated by way of said actuation cylinder, fedback being further provided by way of said sensors.

* * * * *